US010512952B2

(12) United States Patent
Urakami

(10) Patent No.: US 10,512,952 B2
(45) Date of Patent: Dec. 24, 2019

(54) INTRA-PIPE TURBINE BLAST SYSTEM

(71) Applicants: URAKAMI LLC, Kanagawa (JP); DAIICHI SERVICE CO., LTD., Shizuoka (JP)

(72) Inventor: Fukashi Urakami, Kanagawa (JP)

(73) Assignees: URAKAMI LLC, Kanagawa (JP); DAIICHI SERVICE CO., LTD., Shizuoka (JP)

( * ) Notice: Subject to any disclaimer, the term of this patent is extended or adjusted under 35 U.S.C. 154(b) by 231 days.

(21) Appl. No.: 15/570,667

(22) PCT Filed: Jan. 27, 2016

(86) PCT No.: PCT/JP2016/052358
§ 371 (c)(1),
(2) Date: Oct. 30, 2017

(87) PCT Pub. No.: WO2016/125659
PCT Pub. Date: Aug. 11, 2016

(65) Prior Publication Data

US 2019/0126329 A1 May 2, 2019

(30) Foreign Application Priority Data

Feb. 4, 2015 (JP) ..... 2015-020088

(51) Int. Cl.
*B08B 9/032* (2006.01)
*B08B 9/035* (2006.01)
(Continued)

(52) U.S. Cl.
CPC ..... *B08B 9/0328* (2013.01); *B08B 9/032* (2013.01); *B08B 9/035* (2013.01); *B08B 9/043* (2013.01);
(Continued)

(58) Field of Classification Search
CPC ..... B08B 9/0328; B08B 9/032; B08B 9/035; B08B 9/043; B08B 9/0433; B08B 9/047;
(Continued)

(56) References Cited

U.S. PATENT DOCUMENTS 4,170,902 A 10/1979 Pallan
2015/0121646 A1 5/2015 Urakami

FOREIGN PATENT DOCUMENTS

JP H04-66154 A 3/1992
JP H06-66776 A 3/1994
(Continued)

OTHER PUBLICATIONS

WO2014010535A2 machine translation (Year: 2014).*

*Primary Examiner* — Michael E Barr
*Assistant Examiner* — Tinsae B Ayalew
(74) *Attorney, Agent, or Firm* — Taro Yagichi

(57) ABSTRACT

The object of the invention is to provide a device which can, with high efficiency, polish and clean the inner surface of a pipe, dry the wet inner surface of the pipe, and perform coating, wherein the device does not require a large pump or a large motive force, and does not require a blast hose or a suction hose. More specifically, provided is an intra-pipe turbine blast system that moves along the inside of a pipe and performs work by spraying a fluid toward the inside of the pipe, wherein: a gas injected from a fluid supply device to the upstream-side end inside the pipe imparts speed to a mixed phase fluid consisting of a liquid and solid particles which are likewise injected into the pipe; the flow speed of the mixed phase fluid is set to 3 m per second which is the critical speed at which solid particles can float without precipitating in the liquid, and as a result of such setting, there is a great effect on reducing the energy required for causing the mixed phase fluid to move; and the mixed phase fluid with such setting is injected at a high speed from a
(Continued)

rotation nozzle of a turbine crawler which moves inside the pipe, thereby polishing the inner surface of the pipe, and following the polishing work, the turbine crawler can clean, dry and coat the inner surface of the pipe.

8 Claims, 13 Drawing Sheets

(51) Int. Cl.

| | |
|---|---|
| ***B08B 9/043*** | (2006.01) |
| ***B08B 9/047*** | (2006.01) |
| ***B24C 3/06*** | (2006.01) |
| ***B08B 9/053*** | (2006.01) |
| ***B08B 9/055*** | (2006.01) |
| ***B24C 3/32*** | (2006.01) |

(52) U.S. Cl.
CPC ..... *B08B 9/047* (2013.01); *B08B 9/0433* (2013.01); *B08B 9/0535* (2013.01); *B08B 9/0553* (2013.01); *B08B 9/0558* (2013.01); *B24C 3/06* (2013.01); *B24C 3/325* (2013.01); *B08B 2209/032* (2013.01); *B08B 2209/055* (2013.01)

(58) Field of Classification Search
CPC ... B08B 9/0535; B08B 9/0553; B08B 9/0558; B08B 2209/032; B08B 2209/055; B24C 3/06; B24C 3/325
USPC ..... 134/168 C
See application file for complete search history.

(56) References Cited

FOREIGN PATENT DOCUMENTS

| | | | | |
|---|---|---|---|---|
| JP | 2003-225626 | A | 8/2003 | |
| JP | 201418702 | A | 2/2014 | |
| WO | WO-2014010535 | A2 * | 1/2014 | ..... B08B 9/0433 |

* cited by examiner

INTRA-PIPE TURBINE BLAST SYSTEM

FIELD OF THE INVENTION

The present invention relates to an intra-pipe turbine blast system that moves inside a pipe and performs work for removing foreign objects such as rust and aquatic life attached to the inner surfaces of various pipes such as a penstock in a hydroelectric power station, a water supply pipe, a drainage pipe and a gas pipe, for example, and, after removing them, coats the inside of the pipe with a coating material such as a paint and an anticorrosion alloy.

BACKGROUND OF THE INVENTION

As this type of well-known technology, a method and device for performing work inside a pipe described in Japanese Patent Application Laid-open Publication no. 2003-225626 is known.

An intra-pipe inspection pig described in Japanese Patent Application Laid-open Publication no. H06-66776 is also known.

A device that performs work while moving inside a pipe described in Japanese Patent Application Laid-open Publication no. 2014-18702 is also known.

SUMMARY OF THE INVENTION

Problems that the Invention is to Solve

The method and device for working inside a pipe disclosed in Japanese Patent Application Laid-open Publication no. 2003-225626 and the intra-pipe inspection pig disclosed in Japanese Patent Application Laid-open Publication no. H06-66776 have the following problems to be solved.

In order to clarify the difference between conventional devices and the device of the present invention, the following first describes the device of the present invention. The device of the present invention comprises a mechanism for moving a turbine crawler provided with an intra-pipe surface-contact sealing member along the inner wall of a pipe, which divides the inner space of the pipe into two spaces, i.e., a low-pressure region and a high-pressure region; therefore a fluid in the high-pressure region flows into the low-pressure region at a high speed by going through a small gap between the intra-pipe surface-contact sealing member constituting the turbine crawler and the inner wall of the pipe, so that the inner wall of the pipe can be polished and cleaned with high efficiency, and the wet inner wall of the pipe can be dried. However, in the abovementioned conventional devices, an intra-pipe surface-contact sealing member is not provided, and therefore the inner wall of a pipe is cleaned by blowing it away, or the ability of drying the wet inner wall of the pipe is insufficient.

In the method and device for performing work inside a pipe disclosed in Japanese Patent Application Laid-open Publication no. 2003-225626: a jet emitting mechanism part performs cleaning work by peeling off foreign objects attached to the inner surface of the pipe; the peeled foreign objects are suctioned and collected; and then the inner surface of the pipe is repaired by coating it with a coating material. However, a step of forcibly drying the wet inner surface of the pipe, which should indispensably be performed between the step of cleaning work and the step of repair, is not described.

In order to coat the inner surface of the pipe with high efficiency, a step of forcibly drying the wet inner surface of the pipe is indispensable. However, in the case that the wet inner surface of the pipe is dried naturally, it takes much time to do it, and if much time is required, the iron surface that has been cleaned up might be rusted again.

Accordingly, the following shows a first problem to be technically solved by the present invention.

The device of the present invention comprises a mechanism for moving a turbine crawler provided with an intra-pipe surface-contact sealing member along the inner wall of a pipe, which divides the inner space of the pipe into two spaces, i.e., a low-pressure region and a high-pressure region; therefore a fluid in the high-pressure region flows into the low-pressure region at a high speed by going through a small gap between the intra-pipe surface-contact sealing member constituting the turbine crawler and the inner wall of the pipe, so that the inner wall of the pipe can be polished and cleaned with high efficiency, and the wet inner wall of the pipe can be dried.

Next, the following shows a second problem to be technically solved by the present invention.

The device that performs work while moving inside a pipe disclosed in Japanese Patent Application Laid-open Publication no. 2014-18702 is a device proposed by the present inventor.

The device comprises a mechanism for moving an intra-pipe mobile provided with an intra-pipe surface-contact sealing member along the inner wall of a pipe, which divides the inner space of the pipe into two spaces, i.e., a low-pressure region and a high-pressure region; therefore a fluid in the high-pressure region flows into the low-pressure region at a high speed by going through a small gap between the intra-pipe surface-contact sealing member constituting the intra-pipe mobile and the inner wall of the pipe, so that the inner wall of the pipe can be polished and cleaned with high efficiency, and the wet inner wall of the pipe can be dried. However, the device has a problem to be solved as follows.

The following describes a problem that occurs in the case in which polishing material blast cleaning work is performed in the abovementioned device using compressed air against the inner surface of an iron pipe of 90 cm in inner diameter and 2000 m in length disposed horizontally, as an exemplary problem to be solved in conventional devices.

Since the inner area of the iron pipe is 5652 $m^2$, the total amount of garnet injected inside the iron pipe is approximately 254 tons if 45 kg of garnet is injected per 1 $m^2$ as a polishing material.

Injected garnet needs to be discharged to the outside of the iron pipe, and the flow speed of air flowing inside the iron pipe needs to be 45 m per second in order to transfer the garnet in an air transportation mode. Accordingly, the amount of air flowing inside the iron pipe required for achieving the abovementioned flow speed of air reaches 1700 $m^3$ per minute.

When a roots pump having a maximum delivery pressure of 90 kpa is used in order to achieve the abovementioned amount of flowing air, the motive force required for operating the roots pump reaches 3500 kw.

In other words, it is extremely difficult to obtain a roots pump of 1700 $m^3$ per minute in terms of profits and installation places; it is also extremely difficult to obtain a generator of 3500 kw in terms of profits and installation places.

Next, in order to perform blast work by transporting 35 kg per minute of garnet by air to a blast nozzle inside the iron pipe using an air compressor located outside the iron pipe, wherein the maximum delivery pressure of compressed air is 13 kgf/cm$^2$ and the amount of flowing compressed air discharged is 14 m$^3$/min, a blast hose of 2000 m in length is required for linking a polishing material pumping tank disposed outside the iron pipe on the downstream side of the air compressor to the blast nozzle. If the total pressure loss of the blast hose is 2 gf/cm$^2$, the inner diameter of the blast hose is 102 mm and the outer diameter thereof is 132 mm, and since the weight per 1 m of the blast hose is 7 kg, the total weight of the blast hose having a length of 2000 m reaches 14 tons.

In other words, it is extremely difficult to produce and install a hose reel used for winding and storing the blast hose having a length of 2000 m and a total weight of 14 tons in terms of profits and installation places.

Accordingly, in regard to a second problem to be technically solved according to the present invention, which is a more important problem to be technically solved according to the present invention, the present invention proposes an intra-pipe turbine blast system that neither requires a super-large pump or motive force, as described above, nor requires a long and heavy hose in order to solve a problem of conventional devices, including the device disclosed in Japanese Patent Application Laid-open Publication no. 2014-18702.

Means for Solving the Problems

In order to technically solve the abovementioned problems, the invention according to Claim 1 provides an intra-pipe turbine blast system for performing work by moving along the inside of a pipe and spraying, toward the inside, a single-phase fluid of a gas or a liquid, a two-phase fluid of a gas and a liquid, a two-phase fluid of a gas or liquid and solid particles such as a polishing material, or a three-phase fluid of a gas, liquid and solid particles, comprising:

at least a turbine crawler or a plurality of turbine crawlers for moving along the inside of the pipe and spraying a fluid toward the inside of the pipe, turbine crawler connecting member(s) that are arranged inside the pipe in a series from an upstream side to a downstream side and connect the plurality of turbine crawlers when the plurality of turbine crawlers are disposed, a fluid supply device that is disposed outside the pipe for supplying a fluid from an upstream end of the pipe to the inside of the pipe, and a moving device such as a winch that moves the turbine crawler(s) along the inside of the pipe;

wherein, the turbine crawler comprises at least a mainframe member, an intra-pipe surface-contact sealing member and a rotor;

the mainframe member has an annular shape, the intra-pipe surface-contact sealing member is mounted on an outer peripheral end of the mainframe member, a fluid supply hole is formed at a central part of the mainframe member, and a bearing member is further mounted at the central part of the mainframe member for holding a rotor rotating shaft, which is a member constituting the rotor;

the intra-pipe surface-contact sealing member has an annular shape as a whole and is formed such that it can come into close contact with the inner surface of the pipe;

the rotor comprises the rotor rotating shaft held on the bearing member on one side thereof, a first boss member mounted on the other side of the rotor rotating shaft, a second boss member disposed at an outer peripheral part of the first boss member, and a single or a plurality of rotating nozzle(s) mounted at an outer peripheral part of the second boss member;

when a plurality of turbine crawlers are disposed inside the pipe, rotating joint(s) are disposed as turbine crawler connecting members for connecting a plurality of rotor rotating shafts arranged in a series;

an annular-shaped rotor central space is further formed in the rotor between the outer peripheral surface of the first boss member and the inner peripheral surface of the second boss member, and in the rotor central space, a fluid supplied hole which is one side of the rotor central space faces the fluid supply hole of the mainframe as airtightly as possible, i.e., the fluid supply hole and the fluid supplied hole are linked each other as airtightly as possible and in a mutually rotatable manner;

in the rotor, furthermore, an other side of the rotor central space is blocked airtightly;

in the rotor, furthermore, an upstream-side end of the rotating nozzle is linked to the rotor central space, and a downstream-side end of the rotating nozzle is open to an inner space of the pipe;

as such, in the rotor, a rotor passage is formed from the fluid supply hole of the mainframe as an upstream-side starting point to a rotating nozzle outlet as a downstream-side endpoint via the fluid supplied hole, the rotor central space and the rotating nozzle, and in the rotor passage, wherein an amount per unit time of a fluid flowing into the rotor central space from the fluid supplied hole is a value Q and that the minimum cross-sectional area of the passage through which a fluid having the amount value Q passes is a value A; and in the intra-pipe turbine blast system having the configuration described above, wherein at and after a start of the operation of the fluid supply device, in which a maximum value of the maximum delivery pressure is P0 at said start, a relationship between the value A and absolute pressure values at several positions inside the pipe is set as follows;

under the following conditions: a pressure value at the end of the upstream side of the pipe is P1; a pressure value at a portion immediately before the turbine crawler or a group of turbine crawlers in the upstream-side region of the turbine crawler or the group of turbine crawlers is P2; a pressure value at a portion immediately after the turbine crawler or the group of turbine crawlers in the downstream-side region of the turbine crawler or the group of turbine crawlers is P3; a pressure value at the end of the downstream side of the pipe is P4, P1-P4=PL1; P2-P3=PL2; and PL1-PL2=PL3; the value A is set such that: PL1 that is an overall pressure loss value becomes smaller than P0 that is the maximum delivery pressure value of the fluid supply device but close to P0; and PL2 that is a pressure loss value in the turbine crawler or the group of turbine crawlers becomes smaller than PL1 but close to PL1, i.e., such that when the value A becomes smaller the value of PL2 becomes larger.

The intra-pipe turbine blast system characterized by the abovementioned configuration is provided.

In order to technically solve the abovementioned problems, the invention according to Claim 2 provides an intra-pipe turbine blast system for performing work by moving along the inside of a pipe and spraying, toward the inside, a three-phase fluid of a gas, liquid and solid particles, comprising:

at least a turbine crawler or a plurality of turbine crawlers for moving along the inside of the pipe and spraying a fluid toward the inside of the pipe, turbine crawler connecting member(s) that are arranged inside the pipe in a series from an upstream side to a downstream side and connect the plurality of turbine crawlers when the plurality of turbine crawlers are disposed, a fluid supply device that is disposed outside the pipe for supplying a fluid from an upstream end of the pipe to the inside of the pipe, and a moving device such as a winch that moves the turbine crawler(s) along the inside of the pipe;

wherein, the turbine crawler comprises at least a mainframe member, an intra-pipe surface-contact sealing member and a rotor;

the mainframe member has an annular shape, the intra-pipe surface-contact sealing member is mounted on an outer peripheral end of the mainframe member, a fluid supply hole is formed at a central part of the mainframe member, and a bearing member is further mounted at the central part of the mainframe member for holding a rotor rotating shaft, which is a member constituting the rotor;

the intra-pipe surface-contact sealing member has an annular shape as a whole and is formed such that it can come into a close contact with the inner surface of the pipe;

the rotor comprises the rotor rotating shaft held on the bearing member on one side thereof, a first boss member mounted on the other side of the rotor rotating shaft, a second boss member disposed at an outer peripheral part of the first boss member, and a single or a plurality of rotating nozzle(s) mounted at an outer peripheral part of the second boss member;

when a plurality of turbine crawlers are disposed inside the pipe, rotating joint(s) are disposed as turbine crawler connecting members for connecting a plurality of rotor rotating shafts arranged in a series;

an annular-shaped rotor central space is further formed in the rotor between the outer peripheral surface of the first boss member and the inner peripheral surface of the second boss member, and in the rotor central space, a fluid supplied hole which is one side of the rotor central space faces the fluid supply hole of the mainframe as airtightly as possible, i.e., the fluid supply hole and the fluid supplied hole are linked each other as airtightly as possible and in a mutually rotatable manner;

in the rotor, furthermore, an other side of the rotor central space is blocked airtightly;

in the rotor, furthermore, an upstream-side end of the rotating nozzle is linked to the rotor central space, and a downstream-side end of the rotating nozzle is open to an inner space of the pipe;

as such, in the rotor, a rotor passage is formed from the fluid supply hole of the mainframe as an upstream-side starting point to a rotating nozzle outlet as a downstream-side endpoint via the fluid supplied hole, the rotor central space and the rotating nozzle, and in the rotor passage, wherein an amount per unit time of a fluid flowing into the rotor central space from the fluid supplied hole is a value Q and that the minimum cross-sectional area of the passage through which a fluid having the flowing amount value Q passes is a value A; and in the intra-pipe turbine blast system having the configuration described above, wherein at and after a start of the operation of the fluid supply device, in which a maximum value of the maximum delivery pressure is P0 at said start, a relationship between the value A and absolute pressure values at several positions inside the pipe is set as follows; under the following conditions: a pressure value at the end of the upstream side of the pipe is P1; a pressure value at a portion immediately before the turbine crawler or a group of turbine crawlers in the upstream-side region of the turbine crawler or the group of turbine crawlers is P2; a pressure value at a portion immediately after the turbine crawler or the group of turbine crawlers in the downstream-side region of the turbine crawler or the group of turbine crawlers is P3; a pressure value at the end of the downstream side of the pipe is P4, P1-P4=PL1; P2-P3=PL2; and PL1-PL2=PL3; the value A is set such that: PL1 that is an overall pressure loss value becomes smaller than P0 that is the maximum delivery pressure value of the fluid supply device but close to P0; and PL2 that is a pressure loss value in the turbine crawler or the group of turbine crawlers becomes smaller than PL1 but close to PL1, i.e., such that when the value A becomes smaller the value of PL2 becomes larger;

wherein the intra-pipe turbine blast system is further characterized in that;

the fluid supply device comprises at least a gas pump such as a blower and a roots pump for injecting a gas into the pipe, a liquid pump for injecting a liquid into the pipe, and a solid particle supply device for injecting solid particles into the pipe;

the gas injected from the gas pump imparts speed to a mixed-phase fluid of the liquid and the solid particles flowing inside the pipe;

a flow speed of the mixed-phase fluid of the liquid and the solid particles flowing inside the pipe is set to a flow speed equal to or greater than a critical flow speed at which the solid particles can float without precipitating in the liquid, wherein the flow speed of the mixed-phase fluid is imparted and set by an action of the gas flowing inside the pipe, which is caused by the amount and pressure of the flowing gas.

The intra-pipe turbine blast system characterized by the abovementioned configuration is provided.

In order to technically solve the abovementioned problems, the invention according to Claim 3 provides an intra-pipe turbine blast system for performing work by moving along the inside of a pipe and spraying, toward the inside, a single-phase fluid of a gas or a liquid, a two-phase fluid of a gas and a liquid, a two-phase fluid of a gas or liquid and solid particles such as a polishing material, or a three-phase fluid of a gas, liquid and solid particles, comprising:

at least a turbine crawler or a plurality of turbine crawlers for moving along the inside of the pipe and spraying a fluid toward the inside of the pipe, turbine crawler connecting member(s) that are arranged inside the pipe in a series from an upstream side to a downstream side and connect the plurality of turbine crawlers when the plurality of turbine crawlers are disposed, a fluid supply device that is disposed outside the pipe for supplying a fluid from an upstream end of the pipe to the inside of the pipe, a fluid suction device that is disposed outside the pipe for suctioning the fluid inside the pipe from a downstream end of the pipe, and a moving device such as a winch that moves the turbine crawler(s) along the inside of the pipe;

wherein, the turbine crawler comprises at least a mainframe member, an intra-pipe surface-contact sealing member and a rotor;

the mainframe member has an annular shape, the intra-pipe surface-contact sealing member is mounted on an outer peripheral end of the mainframe member, a fluid supply hole is formed at a central part of the mainframe member, and a bearing member is further mounted at the central part of the mainframe member for holding a rotor rotating shaft, which is a member constituting the rotor;

the intra-pipe surface-contact sealing member has an annular shape as a whole and is formed such that it can come into a close contact with the inner surface of the pipe;

the rotor comprises the rotor rotating shaft held on the bearing member on one side thereof, a first boss member mounted on the other side of the rotor rotating shaft, a second boss member disposed at an outer peripheral part of the first boss member, and a single or a plurality of rotating nozzle(s) mounted at an outer peripheral part of the second boss member;

when a plurality of turbine crawlers are disposed inside the pipe, rotating joints are disposed as turbine crawler connecting members for connecting a plurality of rotor rotating shafts arranged in a series;

an annular-shaped rotor central space is further formed in the rotor between the outer peripheral surface of the first boss member and the inner peripheral surface of the second boss member, and in the rotor central space, a fluid supplied hole which is one side of the rotor central space faces the fluid supply hole of the mainframe as airtightly as possible, i.e., the fluid supply hole and the fluid supplied hole are linked each other as airtightly as possible and in a mutually rotatable manner;

in the rotor, furthermore, an other side of the rotor central space is blocked airtightly;

in the rotor, furthermore, an upstream-side end of the rotating nozzle is linked to the rotor central space, and a downstream-side end of the rotating nozzle is open to the inner space of the pipe;

as such, in the rotor, a rotor passage is formed from the fluid supply hole of the mainframe as an upstream-side starting point to a rotating nozzle outlet as a downstream-side endpoint via the fluid supplied hole, the rotor central space and the rotating nozzle, and in the rotor passage, wherein the amount per unit time of a fluid flowing into the rotor central space from the fluid supplied hole is a value Q and that the minimum cross-sectional area of the passage through which a fluid having the flowing amount value Q passes is a value A; and in the intra-pipe turbine blast system having the configuration described above, wherein at and after a start of the operation of the fluid suction device, in which a absolute value of the maximum suction pressure is P5 at said start, a relationship between the value A and absolute pressure values at several positions inside the pipe is set as follows;

under the following conditions: a pressure value at the end of the upstream side of the pipe is P1; a pressure value at a portion immediately before the turbine crawler or a group of turbine crawlers in the upstream-side region of the turbine crawler or the group of turbine crawlers is P2; a pressure value at a portion immediately after the turbine crawler or the group of turbine crawlers in the downstream-side region of the turbine crawler or the group of turbine crawlers is P3; a pressure value at the end of the downstream side of the pipe is P4, P1-P4=PL1; P2-P3=PL2; and PL1-PL2=PL3; the value A is set such that: PL1 that is an overall pressure loss value becomes smaller than P5 that is the maximum suction pressure value of the fluid suction device but close to P5; and PL2 that is a pressure loss value in the turbine crawler or the group of turbine crawlers becomes smaller than PL1 but close to PL1, i.e., such that when the value A becomes smaller the value of PL2 becomes larger.

The intra-pipe turbine blast system characterized by the abovementioned configuration is provided.

In order to technically solve the abovementioned problems, the invention according to Claim 4 provides an intra-pipe turbine blast system for performing work by moving along the inside of a pipe and spraying, toward the inside, a three-phase fluid of a gas, liquid and solid particles, comprising:

at least a turbine crawler or a plurality of turbine crawlers for moving along the inside of the pipe and spraying a fluid toward the inside of the pipe, turbine crawler connecting member(s) that are arranged inside the pipe in a series from an upstream side to a downstream side and connect the plurality of turbine crawlers when the plurality of turbine crawlers are disposed, a fluid supply device that is disposed outside the pipe for supplying a fluid from an upstream end of the pipe to the inside of the pipe, a fluid suction device that is disposed outside the pipe for suctioning the fluid inside the pipe from a downstream end of the pipe, and a moving device such as a winch that moves the turbine crawler(s) along the inside of the pipe;

wherein, the turbine crawler comprises at least a mainframe member, an intra-pipe surface-contact sealing member and a rotor;

the mainframe member has an annular shape, the intra-pipe surface-contact sealing member is mounted on an outer peripheral end of the mainframe member, a fluid supply hole is formed at a central part of the mainframe member, and a bearing member is further mounted at the central part of the mainframe member for holding a rotor rotating shaft, which is a member constituting the rotor;

the intra-pipe surface-contact sealing member has an annular shape as a whole and is formed such that it can come into close contact with the inner surface of the pipe;

the rotor comprises the rotor rotating shaft held on the bearing member on one side thereof, a first boss member mounted on the other side of the rotor rotating shaft, a second boss member disposed at an outer peripheral part of the first boss member, and a single or a plurality of rotating nozzle(s) mounted at an outer peripheral part of the second boss member;

when a plurality of turbine crawlers are disposed inside the pipe, rotating joint(s) are disposed as turbine crawler connecting members for connecting a plurality of rotor rotating shafts arranged in a series;

an annular-shaped rotor central space is further formed in the rotor between the outer peripheral surface of the first boss member and the inner peripheral surface of the second boss member, and in the rotor central space, a fluid supplied hole which is one side of the rotor central space faces the fluid supply hole of the mainframe as airtightly as possible, i.e., the fluid supply hole and the fluid supplied hole are linked each other as airtightly as possible and in a mutually rotatable manner;

in the rotor, furthermore, an other side of the rotor central space is blocked airtightly;

in the rotor, furthermore, an upstream-side end of the rotating nozzle is linked to the rotor central space, and a downstream-side end of the rotating nozzle is open to the inner space of the pipe;

as such, in the rotor, a rotor passage is formed from the fluid supply hole of the mainframe as an upstream-side starting point to a rotating nozzle outlet as a downstream-side endpoint via the fluid supplied hole, the rotor central space and the rotating nozzle, and in the rotor passage, wherein an amount per unit time of a fluid flowing into the rotor central space from the fluid supplied hole is a value Q and that the minimum cross-sectional area of the passage through which a fluid having the flowing amount value Q passes is a value A; and in the intra-pipe turbine blast system having the configuration described above, wherein at and after a start of the operation of the fluid suction device, in which a absolute value of the maximum suction pressure is P5 at said start, a relationship between the value A and absolute pressure values at several positions inside the pipe is set as follows; under the following conditions: a pressure value at the end of the upstream side of the pipe is P1; a pressure value at a portion immediately before the turbine crawler or a group of turbine crawlers in the upstream-side region of the turbine crawler or the group of turbine crawlers is P2; a pressure value at a portion immediately after the turbine crawler or the group of turbine crawlers in the downstream-side region of the turbine crawler or the group of turbine crawlers is P3; a pressure value at the end of the downstream side of the pipe is P4, P1-P4=PL1; P2-P3=PL2; and PL1-PL2=PL3;

the value A is set such that: PL1 that is an overall pressure loss value becomes smaller than P5 that is the maximum suction pressure value of the fluid suction device but close to P5; and PL2 that is a pressure loss value in the turbine crawler or the group of turbine crawlers becomes smaller than PL1 but close to PL1, i.e., such that when the value A becomes smaller the value of PL2 becomes larger;

wherein the intra-pipe turbine blast system is further characterized in that:

the fluid supply device comprises at least a pipeline for injecting a gas into the pipe, a liquid pump for injecting a liquid into the pipe, and a solid particle supply device for injecting solid particles into the pipe;

the fluid suction device comprises at least a gas pump such as a roots pump for suctioning a gas from the inside of the pipe;

the gas injected from the pipeline for injecting the gas imparts speed to a mixed-phase fluid of the liquid and the solid particle flowing inside the pipes;

a flow speed of the mixed-phase fluid of the liquid and the solid particles flowing inside the pipe is set to a flow speed equal to or greater than the critical flow speed at which the solid particles can float without precipitating in the liquid, wherein the flow speed of the mixed-phase fluid is imparted and set by an action of the gas flowing inside the pipe, which is caused by the amount and pressure of the flowing gas.

The intra-pipe turbine blast system characterized by the abovementioned configuration is provided.

In order to technically solve the abovementioned problems, the invention according to Claim 3 provides the intra-pipe turbine blast system according to Claims 1-4, wherein in the rotor, the shaft line of a jet sprayed from the rotating nozzle outlet is disposed at a position where the jet imparts rotating torque to the rotor The device of the present invention comprises a mechanism for moving a turbine crawler 2 provided with an intra-pipe surface-contact sealing member 21 along the inner wall of a pipe 1, which divides the inner space of the pipe 1 into two spaces, i.e., a low-pressure region and a high-pressure region; therefore, the turbine crawler 2 receives a strong pressure that acts from a high-pressure region to a low-pressure region.

The running speed of the turbine crawler 2 can be controlled as follows: a winch 7 is disposed outside the pipe 1; the turbine crawler 2 is connected to the end of a wire rope 201 to be taken up by the winch 7; the turbine crawler 2 is allowed to run along the pipe 1 by winding or feeding out the wire rope 701 by means of the which 7; and the winding or feeding-out speed of the wire rope 701 is controlled, so that the running speed of turbine crawler 2 can be controlled.

On the upstream-side end of the pipe 1, a pipe end member 9 is disposed. The pipe end member 9 is constituted of an upstream-side fluid inlet 902, a plurality of wire rope guide rollers 903 and a wire rope seal 904.

Effect of the Invention

The present invention is effective in performing points shown below.

In the device of the present invention that moves inside a pipe and performs work for removing foreign objects such as rust and aquatic life attached to the inner surfaces of various pipes such as a penstock in a hydroelectric power station, a water supply pipe, a drainage pipe and a gas pipe, for example, and, after removing them, coats the inside of the pipe with a coating material such as a paint and an anticorrosion alloy, the intra-pipe turbine blast system is provided that can polish and clean the inner surface of a pipe with high efficiency as well as dry the wet inner surface of the pipe with high efficiency. Moreover, the intra-pipe turbine blast system is provided that neither requires a super-large pump or motive force, as described above, nor requires a long and heavy hose.

DETAILED DESCRIPTION OF THE INVENTION

Figure 1:
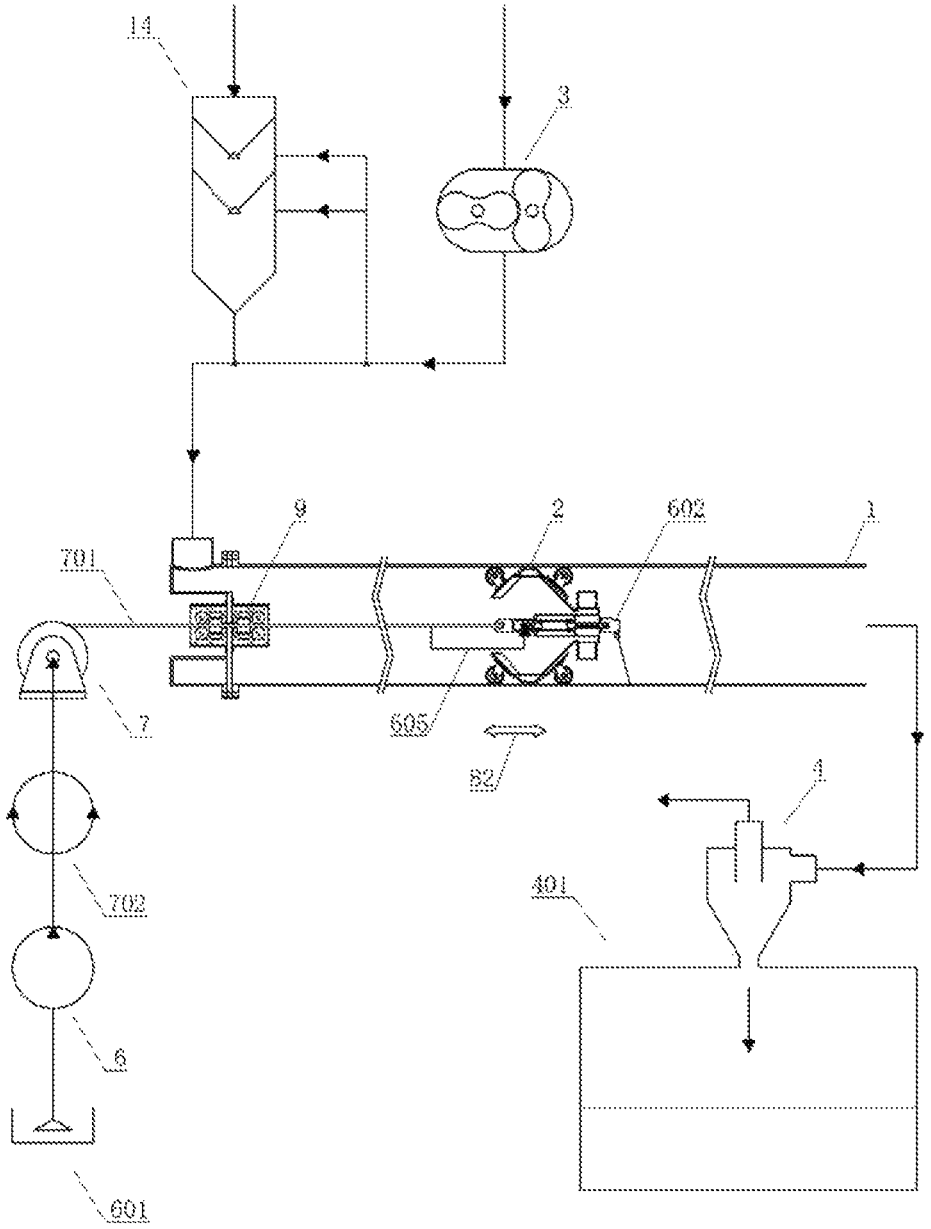
FIG. 1 is an overall view of the configuration of an intra-pipe turbine blast system according to a first preferable embodiment that was constructed according to the present invention.
Figure 2:
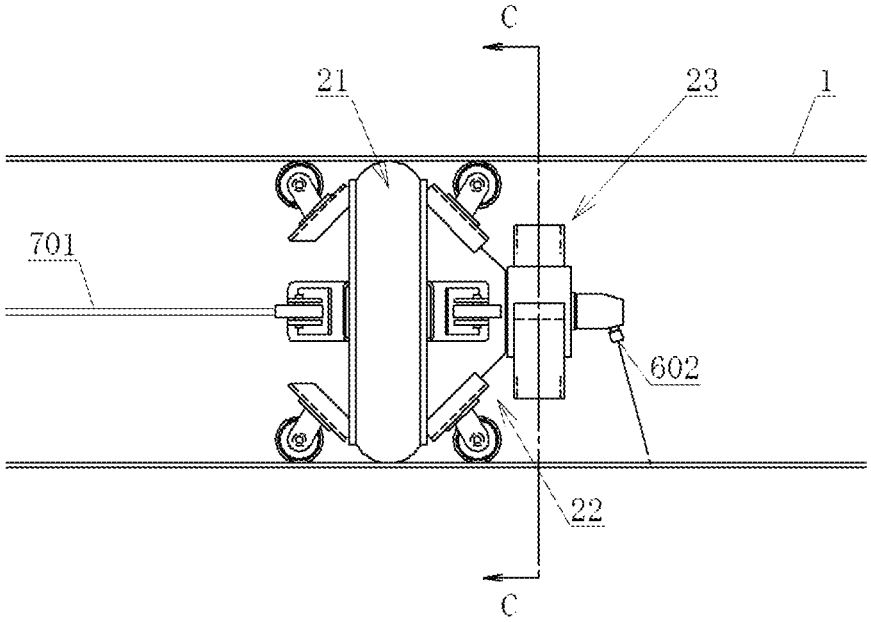
FIG. 2 is a front view of a turbine crawler 2 shown in the first preferable embodiment through a sixth preferable embodiment of an intra-pipe turbine blast system that was constructed according to the present invention.
Figure 3:
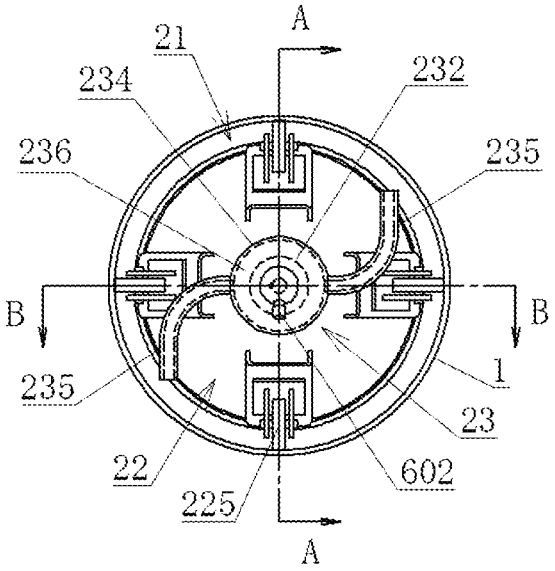
FIG. 3 is a right-side view of the turbine crawler 2 shown in FIG. 2.
Figure 4:
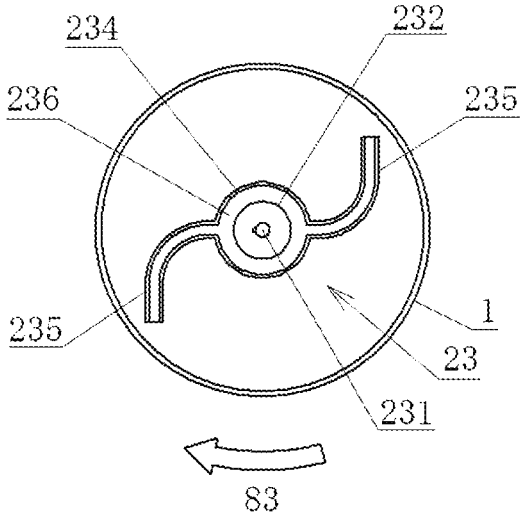
FIG. 4 is a sectional view seeing from the arrow direction of a C-C line in FIG. 2.
Figure 5:
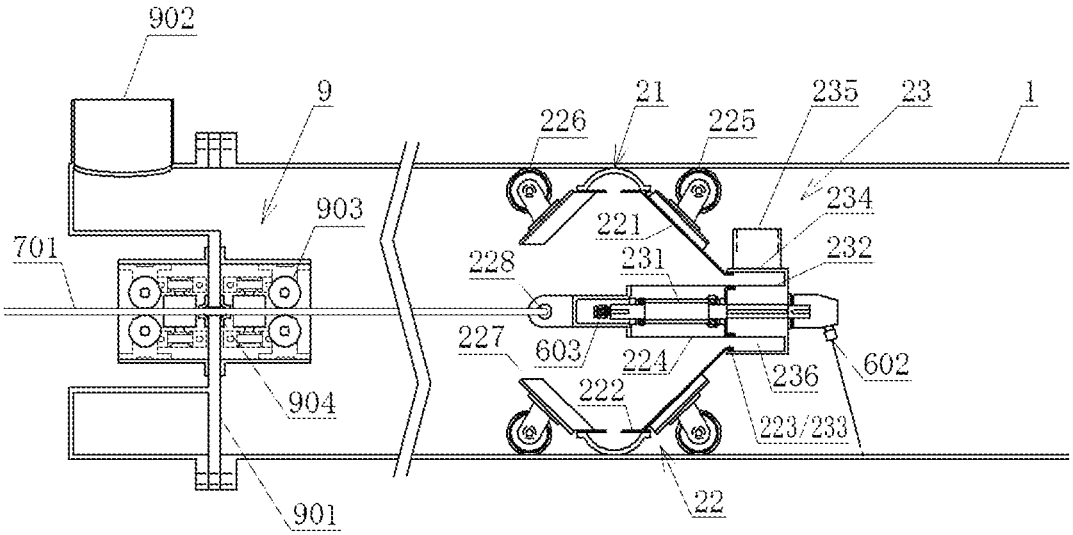
FIG. 5 is a sectional view seeing from the arrow direction of a A-A line in FIG. 2.
Figure 6:
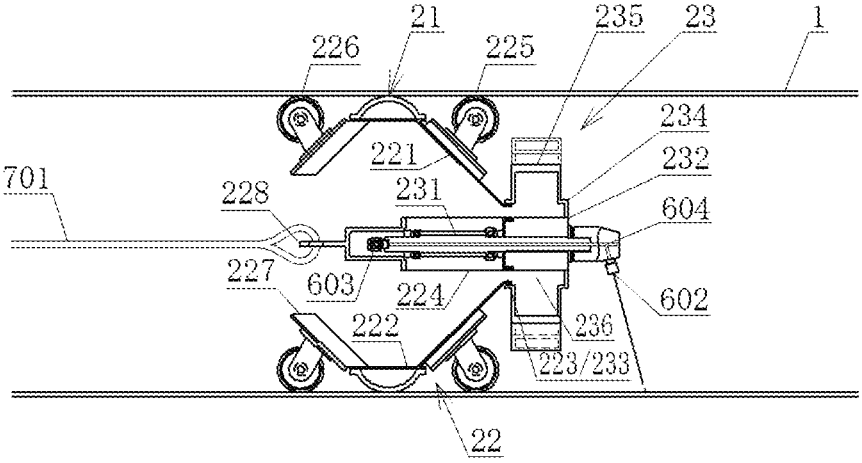
FIG. 6 is a sectional view seeing from the arrow direction of a B-B line in FIG. 2.

The following describes preferable embodiments of devices constructed according to the present invention in detail with reference to drawings.

In order to facilitate the understanding of the present invention, the following describes preferable embodiments showing specific values of the diameter and length of a pipe and the flow speed of a fluid.

Embodiments

With reference to FIGS. 1-6, the present invention proposes an intra-pipe turbine blast system according to a first preferable embodiment relating to Claim 1, which is constructed according to the present invention.

The intra-pipe turbine blast system performs work by moving along the inside of a pipe and spraying, toward the inside, a two-phase fluid of a gas and solid particles such as a polishing material, or a three-phase fluid of a gas, a liquid and solid particles.

The intra-pipe turbine blast system comprises at least a turbine crawler 2 that moves along the inside of the pipe 1 and sprays a fluid toward the inside of the pipe, a roots pump 3 as a fluid supply device that is disposed outside the pipe 1 and supplies a fluid from the upstream end of the pipe 1 to the inside of the pipe 1, a polishing material pumping tank 14, and a winch 7 as moving device that moves the turbine crawler along the inside of the pipe 1.

The turbine crawler 2 comprises at least a mainframe member 22, an intra-pipe surface-contact sealing member 21 and a rotor 23.

The mainframe member 22 has an annular shape in which its center line is approximately the same as the center line of the pipe 1, the intra-pipe surface-contact sealing member 21 is mounted on the outer peripheral end of the mainframe member 22, a fluid supply hole 223 is formed at the central part of the mainframe member 22, and a bearing member 224 is further mounted at the central part of the mainframe member 22 for holding a rotor rotating shaft 231, which is a member constituting the rotor 23;

the intra-pipe surface-contact sealing member 21 has an annular shape as a whole and is formed such that it can come into a close contact with the inner surface of the pipe 1;

the rotor 23 comprises the rotor rotating shaft 231 held on the bearing member 224 on one side thereof, a first boss member 232 mounted on the other side of the rotor rotating shaft 231, a second boss member 234 disposed at the outer peripheral part of the first boss member 232, and a single or a plurality of rotating nozzle(s) 235 mounted at the outer peripheral part of the second boss member 234;

an annular-shaped rotor central space 236 is formed in the rotor 23 between the outer peripheral surface of the first boss member 232 and the inner peripheral surface of the second boss member 234, and in the rotor central space 236, a fluid supplied hole 233 at one end surface thereof faces the fluid supply hole 223 of the mainframe as airtightly as possible, i.e., the fluid supply hole 223 and the fluid supplied hole 233 are linked each other as airtightly as possible and in a mutually rotatable manner;

in the rotor 23, furthermore, the other end of the rotor central space 236 is blocked airtightly;

in the rotor 23, furthermore, the upstream-side end of the rotating nozzle 235 is linked to the rotor central space 236, and the downstream-side end of the rotating nozzle 235 is open to the inner space of the pipe 1;

thus, in the rotor 23, a rotor passage is formed from the fluid supply hole 223 of the mainframe as an upstream-side starting point to a rotating nozzle outlet as a downstream-side endpoint via the fluid supplied hole 233, the rotor central space 236 and the rotating nozzle 235.

When the roots pump 3 is operated in the device having the abovementioned configuration, a large amount of air is injected into the pope 1 from the upstream-side inlet 902 of the pipe 1. The flow of air is blocked because the passage inside the rotating nozzle 235 of the turbine crawler 2 disposed inside the pipe 1 is narrow, and the inner surface of the pipe 1 is in contact with the intra-pipe surface-contact sealing member 21 as airtightly as possible, and therefore the pressure in the upstream-side region of the rotating nozzle 235 rises inside the pipe 1.

There are irregularities caused by corrosion due to rust or the like on the wall of the actual pipe 1, and there are also minute scratches on the surface of the intra-pipe surface-contact sealing member 21, and therefore air flows into the downstream region at a high speed by going through small gaps caused by those irregularities and scratches.

The high-speed air flow is very effective in suctioning and cleaning stains attached to the surface of the pipe 1 or drying moisture attached to the inner surface of the pipe 1.

The turbine crawler 2 receives a strong force toward the downstream side, which is caused by the pressure difference between the upstream region and the downstream region of the turbine crawler 2.

In order to regulate the movement of the turbine crawler 2 and control the moving speed of the turbine crawler 2, the turbine crawler 2 is connected to the end of a power cable/high-pressure hose-containing wire rope 701 to be taken up by the winch 7 in which the take-up direction and the take-up speed can be changed arbitrarily.

The turbine crawler 2 may be connected with a well-known intra-pipe self-propelled device (not shown here) for regulating the movement of the turbine crawler 2 and controlling the moving speed of the turbine crawler 2, in place of the power cable/high-pressure hose-containing wire rope 701 provided with the abovementioned function.

In the turbine crawler 2 constructed according to the present invention, as the turbine crawler 2 is moved inside the pipe 1, the intra-pipe surface-contact sealing member 21, which is mounted on the turbine crawler 2 and in close contact with the inner wall of the pipe 1, rubs the inner wall of the pipe 1, with the result that foreign objects such as rust attached to the inner wall are peeled off.

In the rotor passage, given that the amount per unit time of a fluid flowing into the rotor central space 236 from the fluid supplied hole 233 is a value Q and that the minimum cross-sectional area of the passage through which a fluid having the flowing amount value Q passes is a value A; and in the intra-pipe turbine blast system having the configuration described above, the relationship between the value A and absolute pressure values at several positions inside the pipe 1 at and after a start of the operation of the fluid supply device in which the absolute value of the maximum delivery pressure is P0 at the start, is set as follows;

in other words, given that: a pressure value at the end of the upstream side of the pipe 1 is P1; a pressure value at a portion immediately before the turbine crawler in the upstream side of the turbine crawler 2 is P2; a pressure value at a portion immediately after the turbine crawler in the downstream side of the turbine crawler 2 is P3; and a pressure value at the end of the downstream side of the pipe 1 is P4, wherein: P1-P4=PL1; P2-P3=PL2; and PL1-PL2=PL3;

the value A is set such that: PL1 that is an overall pressure loss value takes a value smaller than P0 that is the maximum delivery pressure value of the fluid supply device but close to P0; and PL2 that is a pressure loss value in the turbine crawler 2 takes a value smaller than PL1 but close to PL1, i.e., such that the value A becomes smaller and thereby the value of PL2 becomes larger.

The following describes an example of performing polishing material blast cleaning work for the inner surface of an iron pipe of 30 cm in inner diameter and 300 m in length disposed horizontally, using the intra-pipe turbine blast system according to the first preferable embodiment, which is constructed according to the present invention.

Since the inner area of the iron pipe is 283 $m^2$, the total amount of garnet injected inside the iron pipe is approximately 13 tons if 45 kg of garnet is injected per 1 $m^2$ as a polishing material.

Injected garnet needs to be discharged to the outside of the iron pipe, and the flow speed of air flowing inside the iron pipe needs to be 45 m per second in order to transfer the garnet in an air transportation mode. Accordingly, the amount of air flowing inside the iron pipe required for achieving the abovementioned flow speed of air reaches 192 $m^3$ per minute.

The critical speed of the two-phase fluid of air and garnet flowing inside the pipe 1 at which garnet can float in the air is approximately 45 m per second.

When a roots pump having a maximum delivery pressure of 90 kpa is used in order to achieve the abovementioned amount of flowing air, the motive force required for operating the roots pump is 395 kw.

Since the gap between the pipe 1 and the intra-pipe surface-contact sealing member 21 is very small, most of air (192 $m^3$ per minute) injected from the upstream-side fluid inlet 902 located at the end of the upstream side of the pipe 1 and approximately all of the flowing garnet flow in the downstream direction through the nozzle port of the rotating nozzle 235; given that the total of the cross-sectional area of the passages of two nozzle ports is 25 $cm^2$, the flow speed of the two-phase fluid passing through the nozzle ports is 1340 m per second, with the result that the fluid causes the rotor 23 to rotate at a fast speed and the high-speed garnet collides with the inner surface of the pipe 1 to perform polishing work for the inner surface. The pressure loss that occurs at the nozzle ports is 84 kpa, and the pressure loss of the pipe 1 having a length of 300 m is 6 kpa.

The garnet used for the polishing work is allowed to flow in the downstream direction of the pipe 1 together with air, passes through the downstream-side fluid outlet 905 and reaches a fluid separator 4; garnet separated by the device is stored in a scrap material container 401, while clean air is released to the atmosphere.

At the end of the rotor rotating shaft 231 constituting the turbine roller 2, a paint nozzle 602 is mounted, and a paint is supplied to the paint nozzle 602 from a paint pump 6 via a swivel joint 603, the power cable/high-pressure hose-containing wire rope 701, a high-pressure paint hose 605, a swivel joint 702, and a paint passage 604.

In the intra-pipe turbine blast system according to the preferable embodiment of the present invention, after finishing polishing work, the inner surface of the pipe 1 is cleaned and dried, and then painting work is performed.

The means for performing work for the inner wall of the pipe 1 are not limited to polishing materials and paint spray. By way of example, an ultrahigh-pressure water-jet nozzle or the like may be provided in place of the paint nozzle 602.

Although it is not shown in FIG. 1, a water pump is added as a fluid supply device at the time of performing wet blast work, and a three-phase fluid of air, water and solid particles is sprayed into the pipe 1. In an intra-pipe turbine blast system according to a second embodiment, which is constructed according to the present invention, as described below, a three-phase fluid of air, water and solid particles as a polishing material is sprayed into the pipe 1, wherein the purpose of employing the three-phase fluid in the second preferable embodiment is to minimize the amount of flowing air in the three-phase fluid, while the purpose of employing the three-phase fluid for wet blast work is not to minimize the amount of flowing air in the three-phase fluid at all, i.e., it is not to reduce the amount of flowing air in the three-phase fluid unlike the purpose of the second preferable embodiment of the present invention, but to prevent dust generated by the blast work from scattering using a water film.

With reference to FIGS. 2-6 and FIGS. 7-9, the present invention proposes an intra-pipe turbine blast system according to a second preferable embodiment relating to Claim 2, which is constructed according to the present invention.

The intra-pipe turbine blast system performs work by moving along the inside of a pipe 1 and spraying, toward the inside, a three-phase fluid of a gas, a liquid and solid particles.

The intra-pipe turbine blast system comprises one turbine crawler that moves along the inside of the pipe 1 and sprays a fluid toward the inside of the pipe, a roots pump 3 as a fluid supply device that is disposed outside the pipe 1 and supplies a fluid from the upstream end of the pipe 1 to the inside of the pipe 1, a polishing material pumping tank 14, a water pump 5, and a winch 7 as a moving device that moves the turbine crawler 2 along the inside of the pipe 1.

The turbine crawler 2 comprises at least a mainframe member 22, an intra-pipe surface-contact sealing member 21 and a rotor 23;

the mainframe member 22 has an annular shape in which its center line is approximately the same as the center line of the pipe 1, the intra-pipe surface-contact sealing member 21 is mounted on the outer peripheral end of the mainframe member 22, a fluid supply hole 223 is formed at the central part of the mainframe member 22, and a bearing member 224 is further mounted at the central part of the mainframe member 22 for holding a rotor rotating shaft 231, which is a member constituting the rotor 23;

the intra-pipe surface-contact sealing member 21 has an annular shape as a whole and is formed such that it can come into a close contact with the inner surface of the pipe 1;

the rotor 23 comprises the rotor rotating shaft 231 held on the bearing member 224 on one side thereof, a first boss member 232 mounted on the other side of the rotor rotating shaft 231, a second boss member 234 disposed at the outer peripheral part of the first boss member 232, and a single or a plurality of rotating nozzle(s) 235 mounted at the outer peripheral part of the second boss member 234;

an annular-shaped rotor central space 236 is formed in the rotor 23 between the outer peripheral surface of the first boss member 232 and the inner peripheral surface of the second boss member 234, and in the rotor central space 236, a fluid supplied hole 233 at one end surface thereof faces the fluid supply hole 223 of the mainframe as airtightly as possible, i.e., the fluid supply hole 223 and the fluid supplied hole 233 are linked each other as airtightly as possible and in a mutually rotatable manner;

in the rotor 23, furthermore, the other end of the rotor central space 236 is blocked airtightly;

in the rotor 23, furthermore, the upstream-side end of the rotating nozzle 235 is linked to the rotor central space 236, and the downstream-side end of the rotating nozzle 235 is open to the inner space of the pipe 1;

thus, in the rotor 23, a rotor passage is formed from the fluid supply hole 223 of the mainframe as an upstream-side starting point to a rotating nozzle outlet as a downstream-side endpoint via the fluid supplied hole 233, the rotor central space 236 and the rotating nozzle 235;

in the rotor passage, given that the amount per unit time of a fluid flowing into the rotor central space 236 from the fluid supplied hole 233 is a value Q and that the minimum cross-sectional area of the passage through which a fluid having the flowing amount value Q passes is a value A; and in the intra-pipe turbine blast system having the configuration described above, the relationship between the value A and absolute pressure values at several positions inside the pipe 1 at and after a start of the operation of the fluid supply device in which the absolute value of the maximum delivery pressure is P0 at the start, is set as follows;

in other words, given that: a pressure value at the end of the upstream side of the pipe 1 is P1; a pressure value at a portion immediately before the turbine crawler in the upstream side of the turbine crawler 2 is P2; a pressure value at a portion immediately after the turbine crawler in the downstream side of the turbine crawler 2 is P3; and a pressure value at the end of the downstream side of the pipe is P4, wherein: P1-P4=PL1; P2-P3=PL2; and PL1-PL2=PL3;

the value A is set such that: PL1 that is an overall pressure loss value takes a value smaller than P0 that is the maximum delivery pressure value of the fluid supply device but close to P0; and PL2 that is a pressure loss value in the turbine crawler 2 takes a value smaller than PL1 but close to PL1, i.e., such that the value A becomes smaller and thereby the value of PL2 becomes larger;

in the intra-pipe turbine blast system characterized by the abovementioned configuration;

the fluid supply device comprises at least a gas pump such as a blower and a roots pump 3 for injecting a gas into the pipe 1, a liquid pump 5 for injecting a liquid into the pipe 1, and a solid particle supply device for injecting solid particles into the pipe 1;

the gas injected from the gas pump imparts speed to a mixed-phase fluid of the liquid and the solid particles flowing inside the pipe 1; and the flow speed of the mixed-phase fluid of the liquid and the solid particles flowing inside the pipe 1 is set to a flow speed equal to or greater than the critical flow speed at which the solid particles can float without precipitating in the liquid, and the flow speed of the mixed-phase fluid is imparted by and set on the basis of the action of a gas flowing inside the pipe 1, which is caused by the amount and pressure of the flowing gas.

As the problem that should be solved in conventional devices, the section of the problems that the invention is to solve above describes a problem that occurs in the case in which polishing material blast cleaning work is performed using compressed air against the inner surface of an iron pipe of 90 cm in inner diameter and 2000 m in length disposed horizontally.

In other words, since the inner area of the iron pipe is 5652 $m^2$, the total amount of garnet injected inside the iron pipe is approximately 254 tons if 45 kg of garnet is injected per 1 $m^2$ as a polishing material.

Injected garnet needs to be discharged to the outside of the iron pipe, and the flow speed of air flowing inside the iron pipe needs to be 45 m per second in order to transfer the garnet in an air transportation mode. Accordingly, the amount of air flowing inside the iron pipe required for achieving the abovementioned flow speed of air reaches 1700 $m^3$ per minute.

When a roots pump having a maximum delivery pressure of 90 kpa is used in order to achieve the abovementioned amount of flowing air, the motive force required for operating the roots pump reaches 3500 kw.

In other words, it is extremely difficult to obtain a roots pump of 1700 $m^3$ per minute in terms of profits and installation places; it is also extremely difficult to obtain a generator of 3500 kw in terms of profits and installation places.

Next, in order to perform blast work by transporting 35 kg per minute of garnet by air to a blast nozzle inside the iron pipe using an air compressor located outside the iron pipe, wherein the maximum delivery pressure of compressed air is 13 kgf/$cm^2$ and the amount of flowing compressed air discharged is 14 $m^3$/min, a blast hose of 2000 m in length is required for linking a polishing material pumping tank disposed outside the iron pipe on the downstream side of the air compressor to the blast nozzle. If the total pressure loss of the blast hose is 2 kgf/$cm^2$, the inner diameter of the blast hose is 102 mm and the outer diameter thereof is 132 mm, and since the weight per 1 m of the blast hose is 7 kg, the total weight of the blast hose having a length of 2000 m reaches 14 tons.

In other words, it is extremely difficult to produce and install a hose reel used for winding and storing the blast hose having a length of 2000 m and a total weight of 14 tons in terms of profits and installation places.

Accordingly, in regard to important technical problems to be solved by the present invention, the present invention proposes an intra-pipe turbine blast system that neither requires a super-large pump or motive force, nor requires a long and heavy hose in order to solve the abovementioned problems of conventional devices.

The following describes a work example in which polishing material blast cleaning work is performed using compressed air against the inner surface of an iron pipe of 90 cm in inner diameter and 2000 m in length disposed horizontally using the intra-pipe turbine blast system according to the second preferable embodiment, which is constructed according to the present invention.

Since the inner area of the iron pipe is 5652 $m^2$, the total amount of garnet injected inside the iron pipe is approximately 254 tons if 45 kg of garnet is injected per 1 $m^2$ as a polishing material.

Injected garnet needs to be discharged to the outside of the iron pipe, and the flow speed of air flowing inside the iron pipe needs to be 45 m per second in order to transfer the garnet in an air transportation mode. Accordingly, the amount of air flowing inside the iron pipe required for achieving the abovementioned flow speed of air reaches 1700 $m^3$ per minute.

However, if garnet to be injected or injected garnet is transferred in a hydraulic transportation mode in place of an air transportation mode, the flow rate of water flowing inside the iron pipe is as small as 3 m per second, wherein the amount of water required is 180 kg per minute if the amount of flowing garnet is set to 20% relative to the total amount of a flowing two-phase fluid of water and garnet.

In other words, the critical speed of the two-phase fluid of water and garnet flowing inside the pipe 1 at which garnet can float without precipitating in the water is approximately 3 m per second.

If the flow speed of 3 m per second is imparted to the two-phase fluid of water and garnet by the action of air flowing inside the iron pipe, the amount of flowing air required is 115 $m^3$ per minute, and if a roots pump having a maximum delivery pressure of 90 kpa is employed in order to obtain the abovementioned amount of flowing air, the motive force required for operating the roots pump is 240 kw.

In other words, if garnet to be injected or injected garnet is transferred by a three-phase fluid incorporating a hydraulic transportation mode in place of a two-phase fluid employing only an air transportation mode, the motive force required can be approximately 7% of the motive force in the air transportation mode. Accordingly, the initial equipment cost, the equipment and operation cost, etc. can significantly be reduced.

Since the gap between the pipe 1 and the intra-pipe surface-contact sealing member 21 is very small, most of air injected (115 $m^3$ per minute) from the upstream-side fluid inlet 902 located at the end of the upstream side of the pipe 1, most of water injected (180 kg per minute) and approximately all of the flowing garnet flow in the downstream direction through the nozzle port of the rotating nozzle 235; given that the total of the cross-sectional area of the passages of two nozzle ports is 72 $cm^2$, the flow speed of the three-phase fluid passing through the nozzle ports is 265 m per second, with the result that the fluid causes the rotor 23 to rotate at a fast speed and the high-speed garnet collides with the inner surface of the pipe 1 to perform polishing work for the inner surface. The pressure loss that occurs at the nozzle ports is 78 kpa, and the pressure loss of the pipe 1 having a length of 2000 m is close to zero. The garnet used for the polishing work is allowed to flow in the downstream direction of the pipe 1 together with air, passes through the downstream-side fluid outlet 905 and reaches a fluid separator 4; garnet separated by the device is stored in a scrap material container 401, while clean air is released to the atmosphere.

As the problem that should be solved in conventional devices, the section of the problems that the invention is to solve above describes a problem that occurs in the case in which polishing material blast cleaning work is performed using compressed air against the inner surface of an iron pipe of 90 cm in inner diameter and 2000 m in length disposed horizontally.

In other words, in order to perform blast work by transporting 35 kg per minute of garnet by air to a blast nozzle inside the iron pipe using an air compressor located outside the iron pipe, wherein the maximum delivery pressure of compressed air is 13 $kgf/cm^2$ and the amount of flowing compressed air discharged is 14 $m^3$/min, a blast hose of 2000 m in length is required for linking a polishing material pumping tank disposed outside the iron pipe on the downstream side of the air compressor to the blast nozzle. If the total pressure loss of the blast hose is 2 $kgf/cm^2$, the inner diameter of the blast hose is 102 mm and the outer diameter thereof is 132 mm, and since the weight per 1 m of the blast hose is 7 kg, the total weight of the blast hose having a length of 2000 m reaches 14 tons.

In other words, it is extremely difficult to produce and install a hose reel used for winding and storing the blast hose having a length of 2000 m and a total weight of 14 tons in terms of profits and installation places.

In the present invention, however, the initial equipment cost, the equipment and operation cost, etc. can significantly be lowered, because no blast hose required in a conventional device is not required.

With reference to FIGS. 2-6 and FIG. 10, an intra-pipe turbine blast system according to a third preferable embodiment relating to Claims 1 and 2, which is constructed according to the present invention, is as follows.

Figure 7:
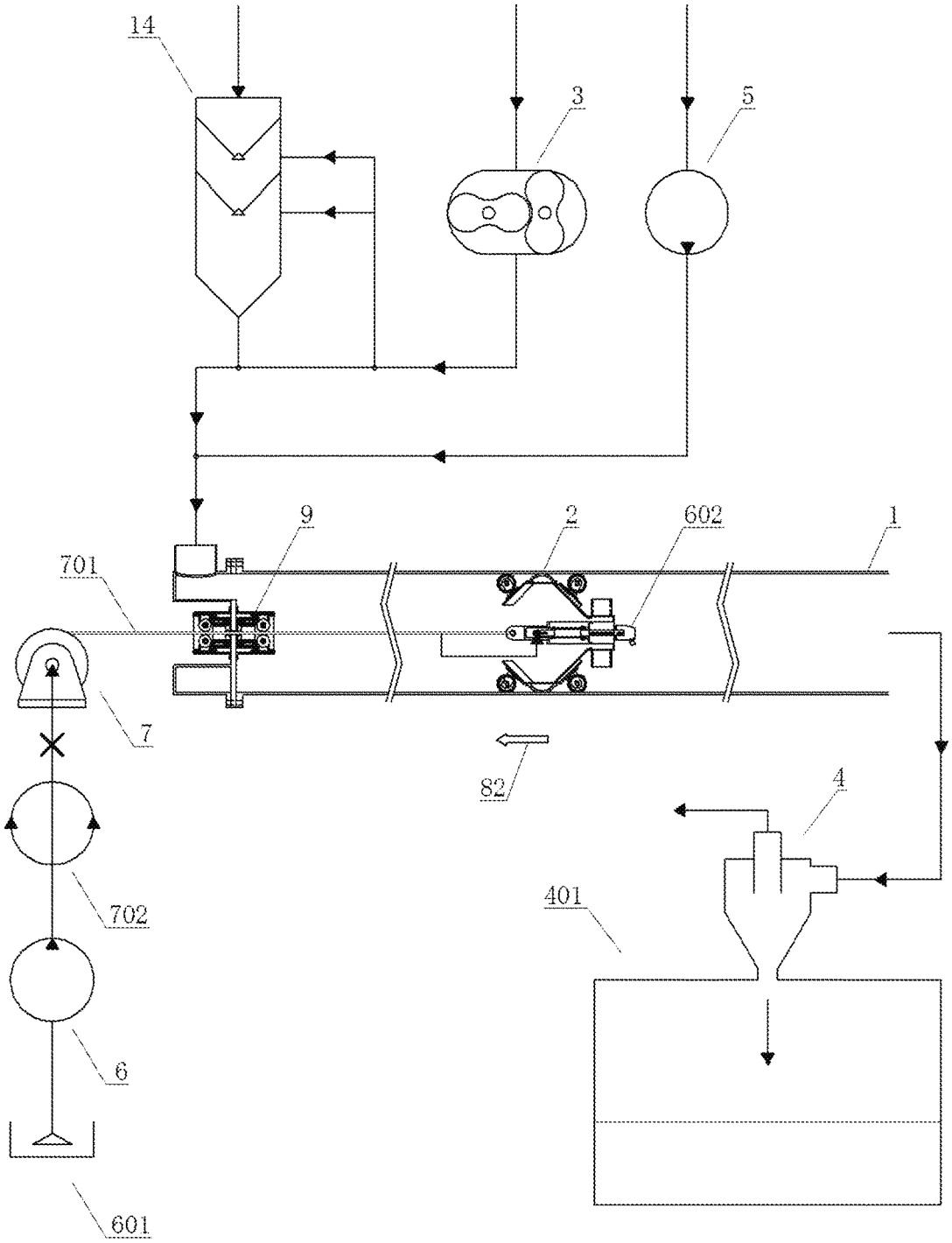
FIG. 7 is an overall view of the configuration of an intra-pipe turbine blast system according to a second preferable embodiment that was constructed according to the present invention, wherein the turbine crawler 2 is performing abrasive blast work inside a pipe 1 while moving toward the upstream direction.
Figure 8:
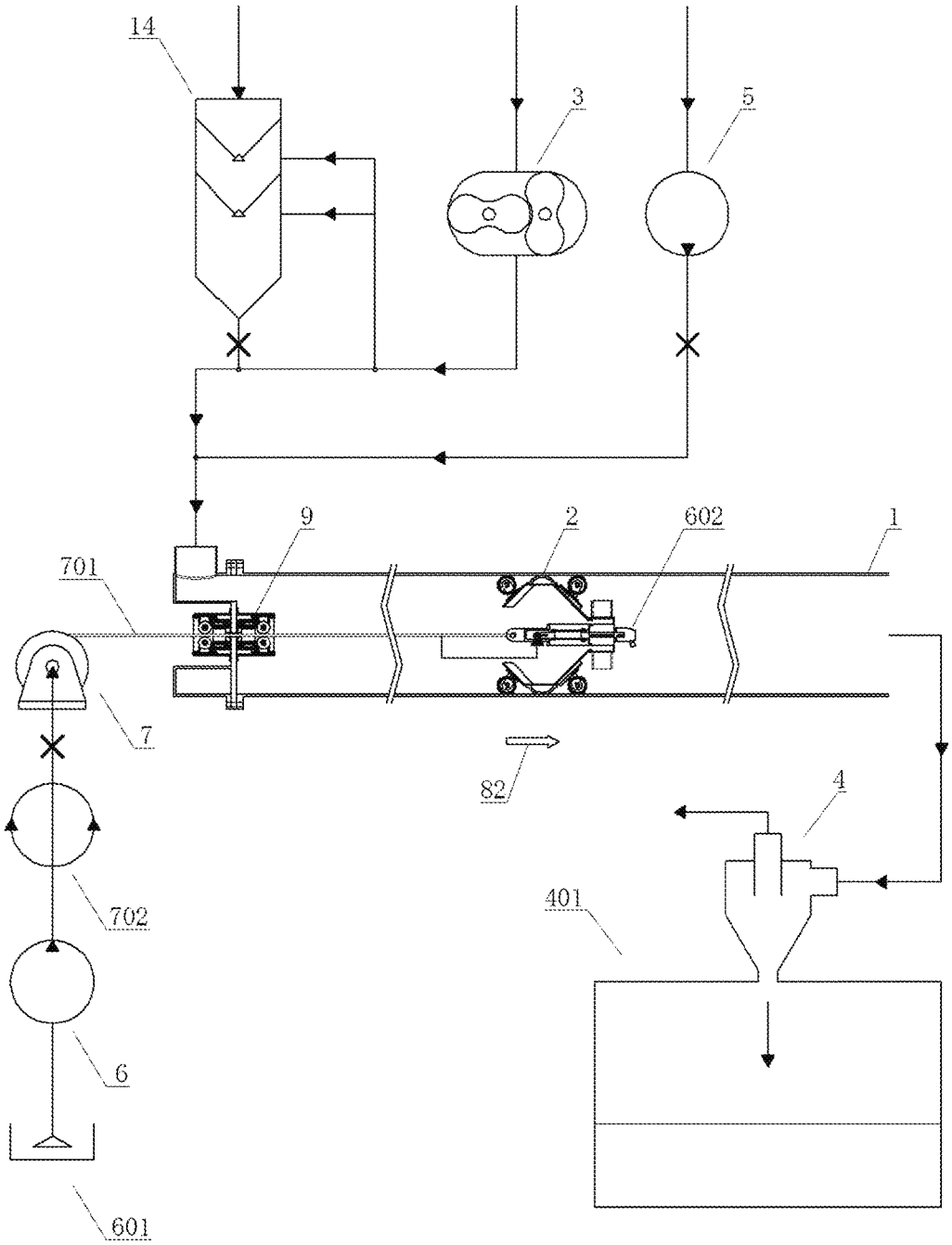
FIG. 8 is an overall view of the configuration of an intra-pipe turbine blast system according to the second preferable embodiment that was constructed according to the present invention, wherein the turbine crawler 2 is performing cleaning and drying work inside the pipe 1 while moving toward the downstream direction.
Figure 9:
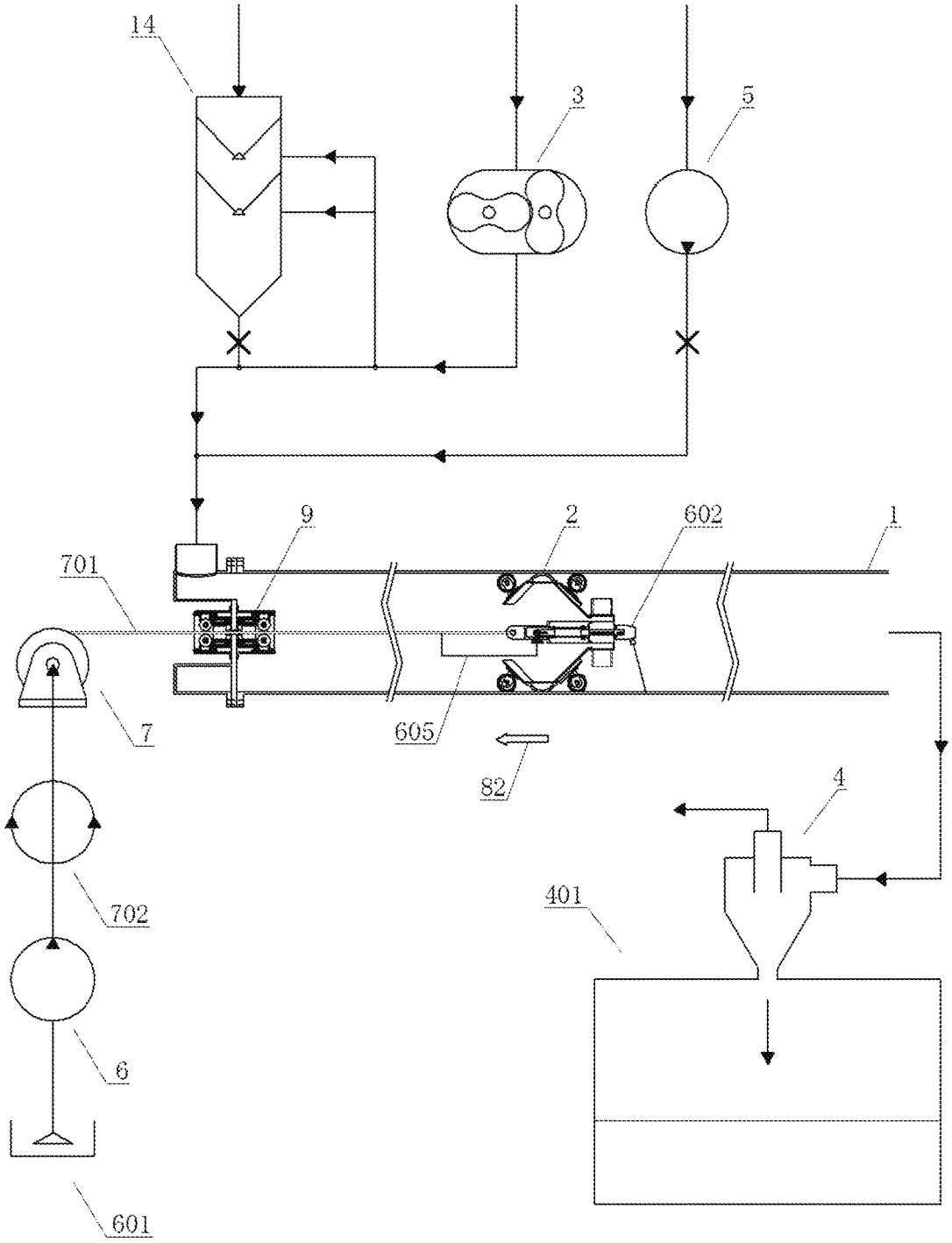
FIG. 9 is an overall view of the configuration of an intra-pipe turbine blast system according to the second preferable embodiment that was constructed according to the present invention, wherein the turbine crawler 2 is performing coating work inside a pipe 1 while moving toward the upstream direction.
Figure 10:
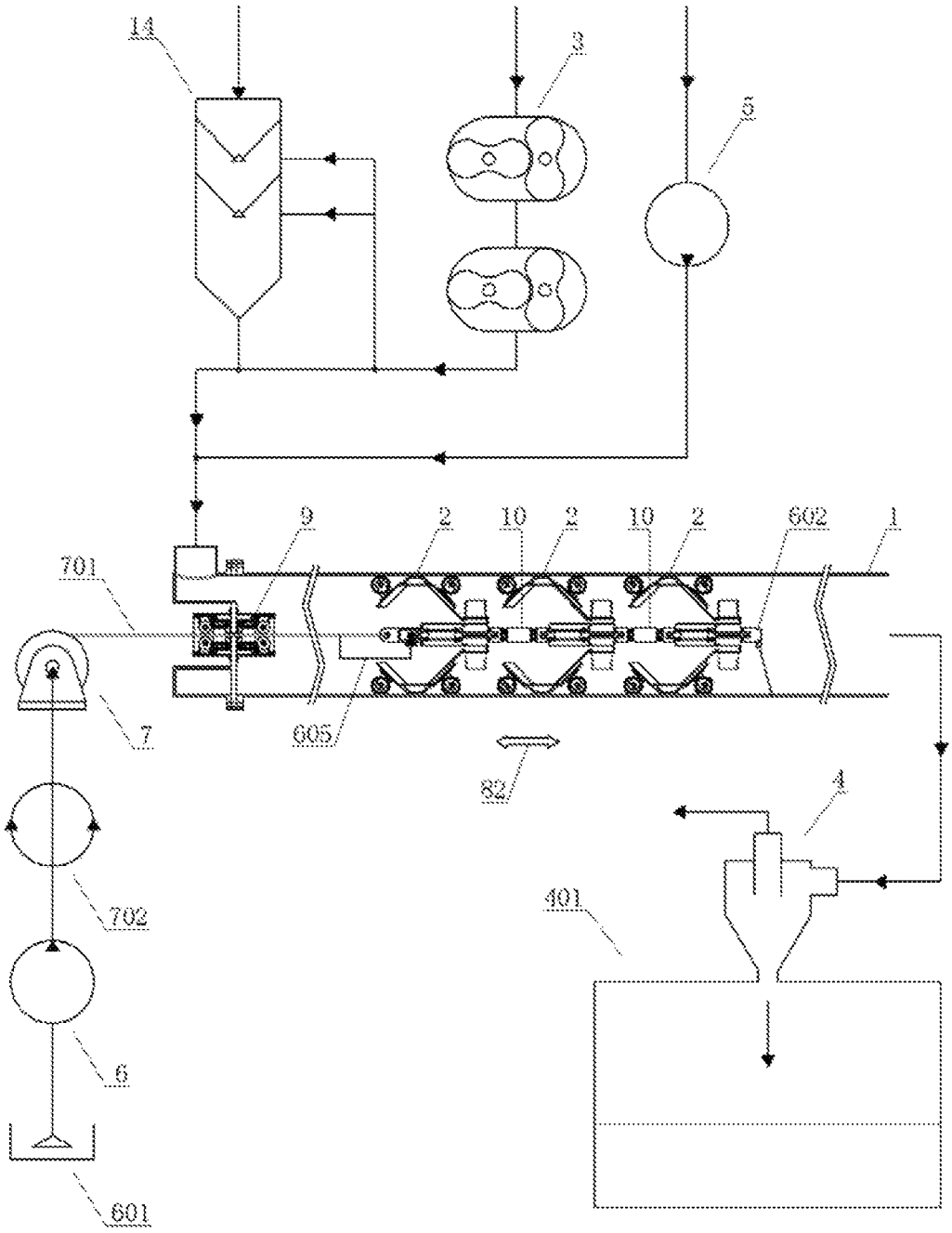
FIG. 10 is an overall view of the configuration of an intra-pipe turbine blast system according to a third preferable embodiment that was constructed according to the present invention.
Figure 11:
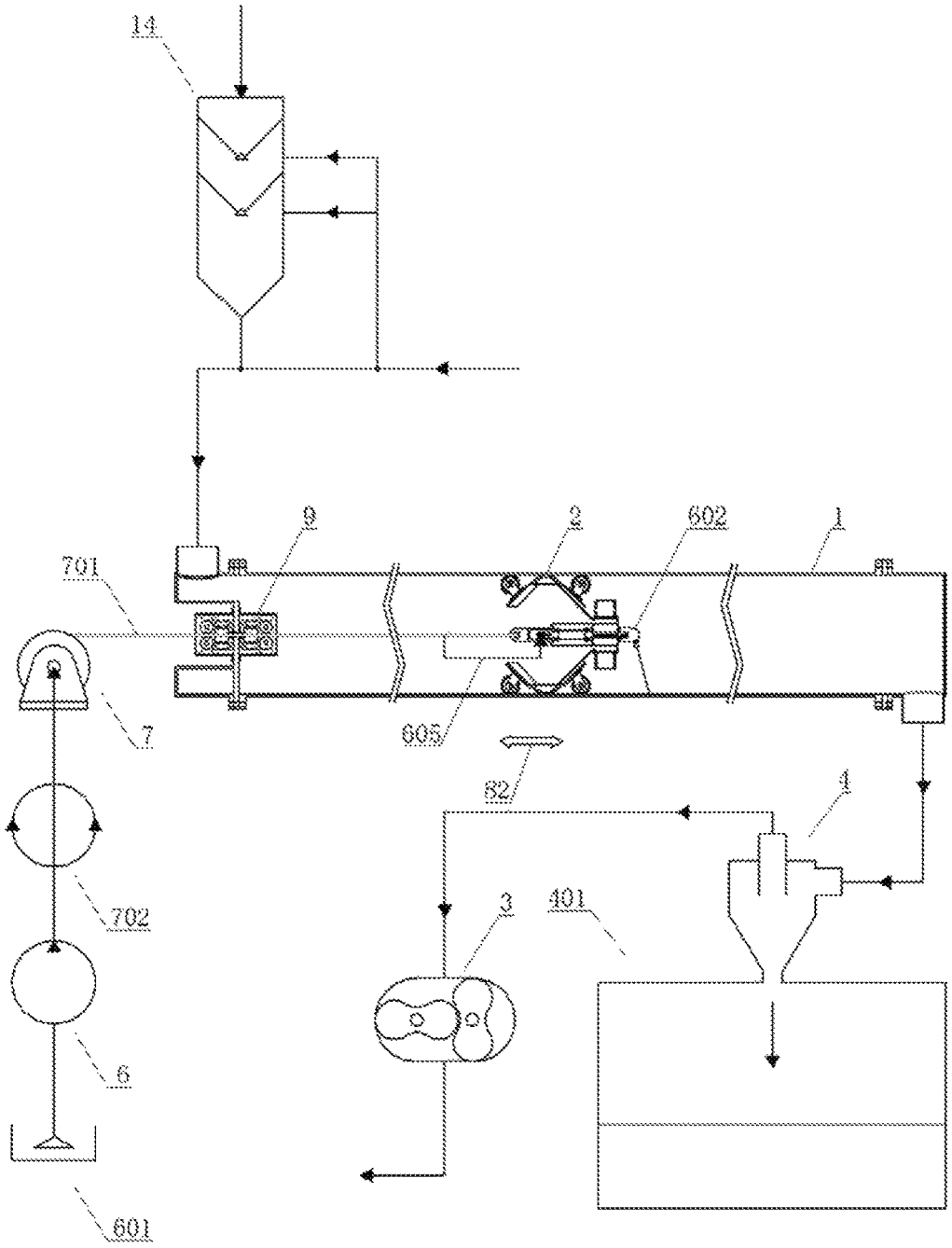
FIG. 11 is an overall view of the configuration of an intra-pipe turbine blast system according to a fourth preferable embodiment that was constructed according to the present invention.

Three turbine crawlers 2 are provided that are linked each other along the shaft line of the pipe 1, in place of one turbine crawler 2 in the intra-pipe turbine blast system shown in FIGS. 7-9.

Two roots pump 3 linked each other in a series are provided, in place of one roots pump in the intra-pipe turbine blast system shown in FIGS. 7-9.

When three turbine crawlers 2 are linked each other, the amount of garnet colliding with the inner surface of the pipe 1 increases three-fold and thereby the polishing performance also increases; however, since the pressure loss of the group of turbine rollers also increases, two roots pump 3 are linked each other in a series in order to increase the pressure of roots pumps 3.

With reference to FIGS. 2-6 and FIG. 11, the present invention proposes an intra-pipe turbine blast system according to a fourth preferable embodiment relating to Claim 3, which is constructed according to the present invention.

The intra-pipe turbine blast system performs work by moving along the inside of a pipe 1 and spraying, toward the inside, a two-phase fluid of a gas and solid particles such as a polishing material or the like, or a three-phase fluid of a gas, a liquid and solid particles.

The intra-pipe turbine blast system comprises one turbine crawler 2 that moves along the inside of the pipe 1 and sprays a fluid toward the inside of the pipe, a polishing material tank 14 as a fluid supply device that is disposed outside the pipe 1 and supplies a fluid from the upstream end of the pipe 1 to the inside of the pipe 1, a roots pump 3 as a fluid suction device that is disposed outside the pipe 1 and suctions the fluid inside the pipe 1 from the downstream end of the pipe 1, and a winch 7 as a moving device that moves the turbine crawler 2 along the inside of the pipe 1;

the turbine crawler 2 comprises at least a mainframe member 22, an intra-pipe surface-contact sealing member 21 and a rotor 23;

the mainframe member 22 has an annular shape in which its center line is approximately the same as the center line of the pipe 1, the intra-pipe surface-contact sealing member 21 is mounted on the outer peripheral end of the mainframe member 22, a fluid supply hole 223 is formed at the central part of the mainframe member 22, and a bearing member 224 is further mounted at the central part of the mainframe member 22 for holding a rotor rotating shaft 231, which is a member constituting the rotor 23;

the intra-pipe surface-contact sealing member 21 has an annular shape as a whole and is formed such that it can come into a close contact with the inner surface of the pipe 1;

the rotor 23 comprises the rotor rotating shaft 231 held on the bearing member 224 on one side thereof, a first boss member 232 mounted on the other side of the rotor rotating shaft 231, a second boss member 234 disposed at the outer peripheral part of the first boss member 232, and a single or a plurality of rotating nozzle(s) 235 mounted at the outer peripheral part of the second boss member 234;

an annular-shaped rotor central space 236 is further formed in the rotor 23 between the outer peripheral surface of the first boss member 232 and the inner peripheral surface of the second boss member 234, and in the rotor central space 236, a fluid supplied hole 233 at one end surface thereof faces the fluid supply hole 223 of the mainframe as airtightly as possible, i.e., the fluid supply hole 223 and the fluid supplied hole 233 are linked each other as airtightly as possible and in a mutually rotatable manner;

in the rotor 23, furthermore, the other end of the rotor central space 236 is blocked airtightly;

in the rotor 23, furthermore, the upstream-side end of the rotating nozzle 235 is linked to the rotor central space 236, and the downstream-side end of the rotating nozzle 235 is open to the inner space of the pipe 1;

thus, in the rotor 23, a rotor passage is formed from the fluid supply hole 223 of the mainframe as an upstream-side starting point to a rotating nozzle outlet as a downstream-side endpoint via the fluid supplied hole 233, the rotor central space 236 and the rotating nozzle 235;

in the rotor passage, given that the amount per unit time of a fluid flowing into the rotor central space 236 from the fluid supplied hole 233 is a value Q and that the minimum cross-sectional area of the passage through which a fluid having the flowing amount value Q passes is a value A;

in the intra-pipe turbine blast system having the configuration described above, the relationship between the value A and absolute pressure values at several positions inside the pipe 1 at and after a start of the operation of the fluid suction device in which the absolute value of the maximum suction pressure is P5 at the start, is set as follows;

in other words, given that: a pressure value at the end of the upstream side of the pipe 1 is P1; a pressure value at a portion immediately before the turbine crawler in the upstream-side region of the turbine crawler 2 is P2; a pressure value at a portion immediately after the turbine crawler in the downstream-side region of the turbine crawler 2 is P3; and a pressure value at the end of the downstream side of the pipe is P4, wherein: P1-P4=PL1; P2-P3=PL2; and PL1-PL2=PL3; and the value A is set such that: PL1 that is an overall pressure loss value takes a value smaller than P5 that is the maximum suction pressure value of the fluid suction device but close to P5; and PL2 that is a pressure loss value in the turbine crawler 2 takes a value smaller than PL1 but close to PL1, i.e., such that the value A becomes smaller and thereby the value of PL2 becomes larger.

With reference to FIGS. 2-6 and FIG. 12, the intra-pipe turbine blast system according to a fifth preferable embodiment relating to Claim 4, which is constructed according to the present invention performs work by moving along the inside of a pipe 1 and spraying, toward the inside, a three-phase fluid of a gas, a liquid and solid particles.

the intra-pipe turbine blast system comprises at least a turbine crawler 2 that moves along the inside of the pipe 1 and sprays a fluid toward the inside of the pipe, a polishing material tank 14 as a fluid supply device that is disposed outside the pipe 1 and supplies a fluid from the upstream end of the pipe 1 to the inside of the pipe 1, a roots pump 3 as a fluid suction device that is disposed outside the pipe 1 and suctions the fluid inside the pipe 1 from the downstream end of the pipe 1, and a winch 7 as a moving device that moves the turbine crawler 2 along the inside of the pipe 1; and the turbine crawler 2 comprises at least a mainframe member 22, an intra-pipe surface-contact sealing member 21 and a rotor 23.

The mainframe member 22 has an annular shape in which its center line is approximately the same as the center line of the pipe 1, the intra-pipe surface-contact sealing member 21 is mounted on the outer peripheral end of the mainframe member 22, a fluid supply hole 223 is formed at the central part of the mainframe member 22, and a bearing member 224 is further mounted at the central part of the mainframe member 22 for holding a rotor rotating shaft 231, which is a member constituting the rotor 23;

the intra-pipe surface-contact sealing member 21 has an annular shape as a whole and is formed such that it can come into a close contact with the inner surface of the pipe 1;

the rotor 23 comprises the rotor rotating shaft 231 held on the bearing member 224 on one side thereof, a first boss member 232 mounted on the other side of the rotor rotating shaft 231, a second boss member 234 disposed at the outer peripheral part of the first boss member 232, and a single or a plurality of rotating nozzle(s) 235 mounted at the outer peripheral part of the second boss member;

an annular-shaped rotor central space 236 is further formed in the rotor 23 between the outer peripheral surface of the first boss member 232 and the inner peripheral surface of the second boss member 234, and in the rotor central space 236, a fluid supplied hole 233 at one end surface thereof faces the fluid supply hole 223 of the mainframe as airtightly as possible, i.e., the fluid supply hole 223 and the fluid supplied hole 233 are linked each other as airtightly as possible and in a mutually rotatable manner;

in the rotor 23, furthermore, the other end of the rotor central space 236 is blocked airtightly;

in the rotor 23, furthermore, the upstream-side end of the rotating nozzle 235 is linked to the rotor central space 236, and the downstream-side end of the rotating nozzle 235 is open to the inner space of the pipe 1;

thus, in the rotor 23, a rotor passage is formed from the fluid supply hole 223 of the mainframe as an upstream-side starting point to a rotating nozzle outlet as a downstream-side endpoint via the fluid supplied hole 233, the rotor central space 236 and the rotating nozzle 235.

In the rotor passage, given that the amount per unit time of a fluid flowing into the rotor central space 236 from the fluid supplied hole 233 is a value Q and that the minimum cross-sectional area of the passage through which a fluid having the flowing amount value Q passes is a value A;

in the intra-pipe turbine blast system having the configuration described above, the relationship between the value A and absolute pressure values at several positions inside the pipe 1 at and after a start of the operation of the fluid suction device in which the absolute value of the maximum suction pressure is P5 at the start, is set as follows;

in other words, given that: a pressure value at the end of the upstream side of the pipe 1 is P1; a pressure value at a portion immediately before the turbine crawler in the upstream-side region of the turbine crawler 2 is P2; a pressure value at a portion immediately after the turbine crawler in the downstream-side region of the turbine crawler 2 is P3; and a pressure value at the end of the downstream side of the pipe 1 is P4, wherein: P1-P4=PL1; P2-P3=PL2; and PL1-PL2=PL3;

the value A is set such that: PL1 that is an overall pressure loss value takes a value smaller than P5 that is the maximum suction pressure value of the fluid suction device but close to P5; and PL2 that is a pressure loss value in the turbine crawler 2 takes a value smaller than PL1 but close to PL1, i.e., such that the value A becomes smaller and thereby the value of PL2 becomes larger;

in the intra-pipe turbine blast system characterized by the abovementioned configuration;

the fluid supply device comprises at least a pipeline for injecting a gas into the pipe 1, a liquid pump 5 for injecting a liquid into the pipe 1, and a solid particle supply device 14 for injecting solid particles into the pipe 1;

the fluid suction device comprises at least a roots pump 3 for suctioning a gas from the inside of the pipe 1;

the gas injected from the pipeline for injecting the gas imparts speed to a mixed-phase fluid of the liquid and the solid particles flowing inside the pipe 1;

the flow speed of the mixed-phase fluid of the liquid and the solid particles flowing inside the pipe 1 is set to a flow speed equal to or greater than the critical flow speed at which the solid particles can float without precipitating in the liquid, and the flow speed of the mixed-phase fluid is imparted by and set on the basis of the action of a gas flowing inside the pipe 1 that is caused by the amount and pressure of the flowing gas.

Figure 12:
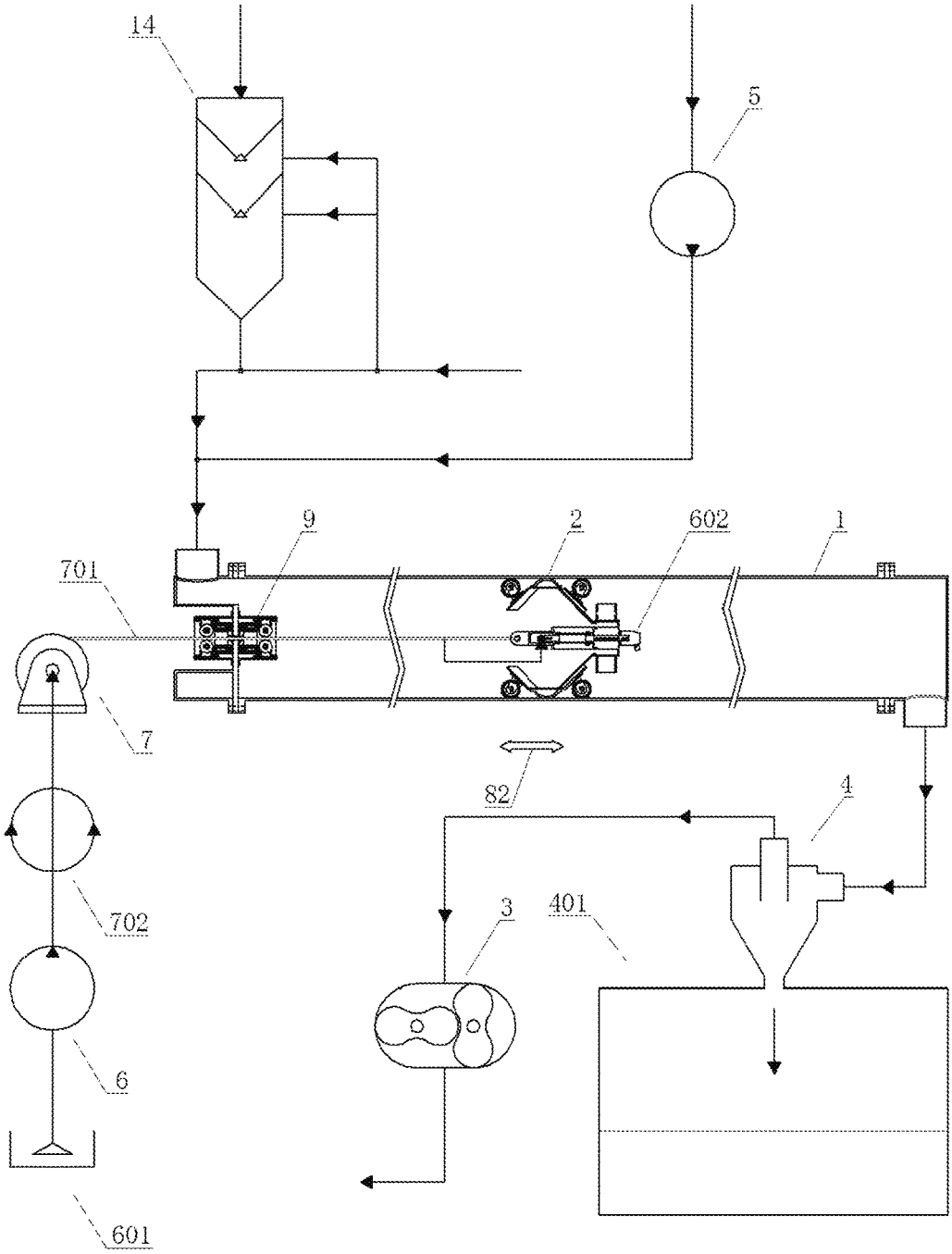
FIG. 12 is an overall view of the configuration of an intra-pipe turbine blast system according to a fifth preferable embodiment that was constructed according to the present invention.
Figure 13:
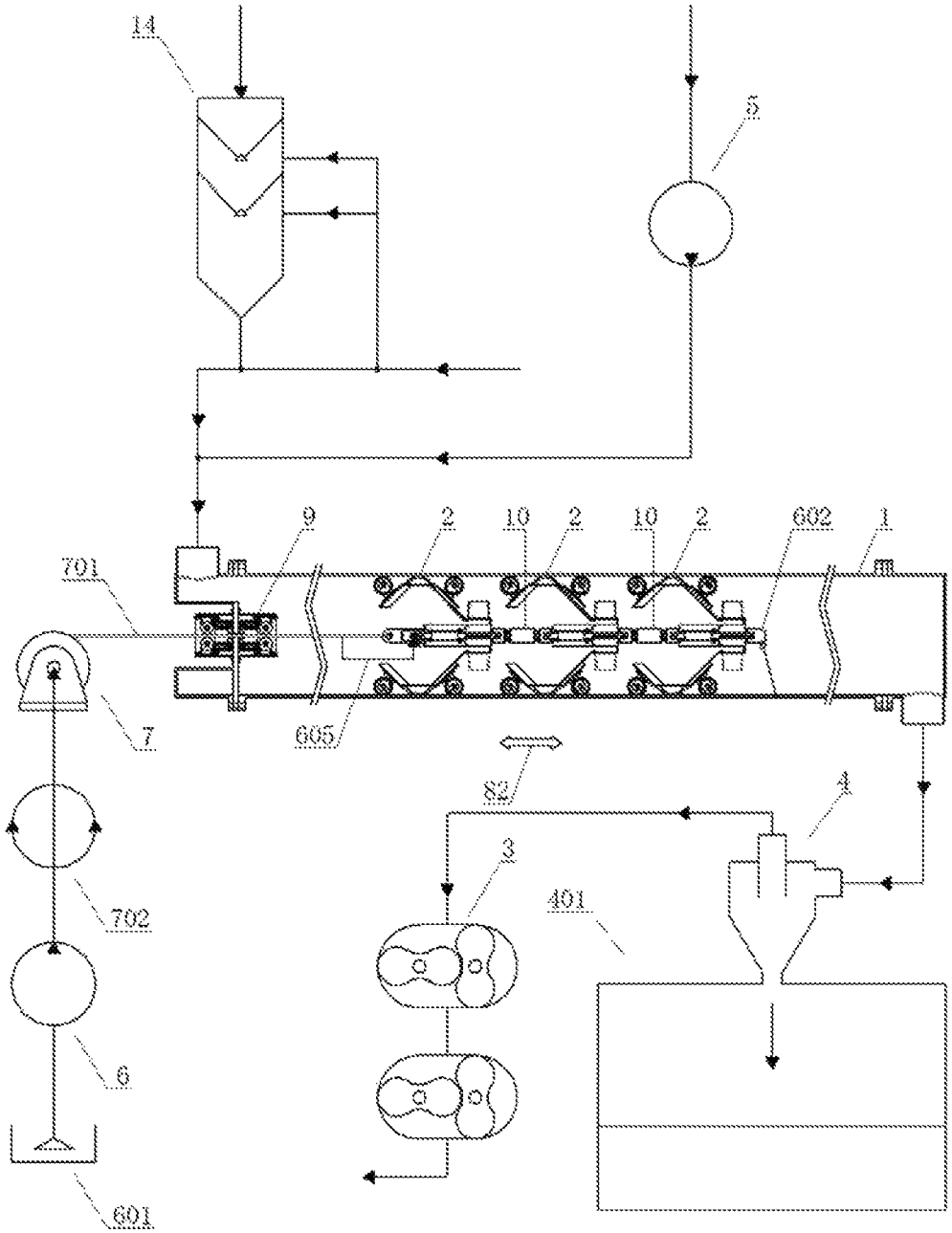
FIG. 13 is an overall view of the configuration of an intra-pipe turbine blast system according to a sixth preferable embodiment that was constructed according to the present invention.

With reference to FIGS. 2-6 and FIG. 13, the intra-pipe turbine blast system according to a sixth preferable embodiment relating to Claims 3-4, which is constructed according to the present invention comprises three turbine crawlers 2 linked each other along the shaft line of the pipe 1, in place of one turbine crawler 2 in the intra-pipe turbine blast system shown in FIG. 12.

Moreover, two roots pump 3 linked each other in a series is provided, in place of one roots pump 3 in the intra-pipe turbine blast system shown in FIG. 12.

When three turbine crawlers 2 are linked each other, the amount of garnet colliding with the inner surface of the pipe 1 increases three-fold and thereby the polishing performance also increases; however, since the pressure loss of the group of turbine rollers also increases, two roots pump 3 are linked each other in a series in order to increase the pressure of roots pumps 3.

Although it has been described according to preferable embodiments above, the device of the present invention can have a wide variety of other embodiments according to claims in addition to the abovementioned embodiments.

While both the device and the pipe are disposed in the atmosphere in the abovementioned description of the device according to preferable embodiments, the device of the present invention can also be applied to the case in which both the device and the pipe are disposed in water.

INDUSTRIAL FIELD OF APPLICATION

The device of the present invention that moves inside a pipe and performs work for removing foreign objects such as rust and aquatic life attached to the inner surfaces of various pipes such as a penstock in a hydroelectric power station, a water supply pipe, a drainage pipe and a gas pipe, for example, and, after removing them, coats the inside of the pipe with a coating material such as a paint and an anticorrosion alloy can advantageously be used as a device that neither requires a large pump or a large motive force nor requires a blast hose or a suction hose.

EXPLANATION OF REFERENCE NUMERALS

1: Pipe
2: Turbine crawler
21: Intra-pipe surface-contact sealing member
22: Mainframe member
221: Conical cylinder case
222: Cylinder case
223: Fluid supply hole
224: Bearing member
225: Downstream-side wheel
226: Upstream-side wheel
227: Upstream-side wheel-mounting bracket
228: Towed fitting
23: Rotor
231: Rotor rotating shaft
232: First boss member
233: Fluid supplied hole
234: Second boss member
235: Rotating nozzle
236: Rotor center space
3: Roots pump
4: Fluid separator
401: Scrap material container
5: Liquid pump
6: Paint pump
601: Paint container
602: Paint nozzle
603: Swivel joint
604: Paint passage
605: High-pressure paint hose
7: Winch
701: Power cable/high-pressure hose-containing wire rope
702: Swivel joint
9: Pipe end member
901: Partition wall
902: Upstream-side fluid inlet
903: Wire rope guide roller
904: Wire rope seal
905: Downstream-side fluid outlet
10: Turbine roller connecting member
14: Polishing material pumping tank
82: Moving direction of a turbine crawler when it is performing work
83: Rotor rotating direction

What is claimed is:

1. An intra-pipe turbine blast system for performing work by moving along the inside of a pipe and spraying, toward the inside, a single-phase fluid of a gas or a liquid, a two-phase fluid of a gas and a liquid, a two-phase fluid of a gas or a liquid and solid particles such as a polishing material, or a three-phase fluid of a gas, a liquid and solid particles, comprising:

at least a turbine crawler or a plurality of turbine crawlers for moving along the inside of the pipe and spraying a fluid toward the inside of the pipe, turbine crawler connecting member(s) that are arranged inside the pipe in a series from an upstream side to a downstream side and connect the plurality of turbine crawlers when the plurality of turbine crawlers are disposed, a fluid supply device that is disposed outside the pipe for supplying a fluid from an upstream end of the pipe to the inside of the pipe, and a moving device such as a winch that moves the turbine crawler(s) along the inside of the pipe;

wherein, the turbine crawler comprises at least a mainframe member, an intra-pipe surface-contact sealing member and a rotor;

the mainframe member has an annular shape, the intra-pipe surface-contact sealing member is mounted on an outer peripheral end of the mainframe member, a fluid supply hole is formed at a central part of the mainframe member, and a bearing member is further mounted at the central part of the mainframe member for holding a rotor rotating shaft, which is a member constituting the rotor;

the intra-pipe surface-contact sealing member has an annular shape as a whole and is formed such that it can come into close contact with the inner surface of the pipe;

the rotor comprises the rotor rotating shaft held on the bearing member on one side thereof, a first boss member mounted on the other side of the rotor rotating shaft, a second boss member disposed at an outer peripheral part of the first boss member, and a single or a plurality of rotating nozzle(s) mounted at an outer peripheral part of the second boss member;

when a plurality of turbine crawlers are disposed inside the pipe, rotating joint(s) are disposed as turbine crawler connecting members for connecting a plurality of rotor rotating shafts arranged in a series;

an annular-shaped rotor central space is further formed in the rotor between the outer peripheral surface of the first boss member and the inner peripheral surface of the second boss member, and in the rotor central space, a fluid supplied hole which is one side of the rotor central space faces the fluid supply hole of the mainframe as airtightly as possible, i.e., the fluid supply hole and the fluid supplied hole are linked with each other as airtightly as possible and in a mutually rotatable manner;

in the rotor, furthermore, an other side of the rotor central space is blocked airtightly;

in the rotor, furthermore, an upstream-side end of the rotating nozzle is linked to the rotor central space, and a downstream-side end of the rotating nozzle is open to an inner space of the pipe;

as such, in the rotor, a rotor passage is formed from the fluid supply hole of the mainframe as an upstream-side starting point to a rotating nozzle outlet as a downstream-side endpoint via the fluid supplied hole, the rotor central space and the rotating nozzle, and in the rotor passage, wherein an amount per unit time of a fluid flowing into the rotor central space from the fluid supplied hole is a value Q and that the minimum cross-sectional area of the passage through which a fluid having the flowing amount value Q passes is a value A; and in the intra-pipe turbine blast system having the configuration described above, wherein at and after a start of the operation of the fluid supply device, in which an absolute value of the maximum delivery pressure is P0 at said start, a relationship between the value A and absolute pressure values at several positions inside the pipe is set as follows;

under the following conditions: a pressure value at the end of the upstream side of the pipe is P1; a pressure value at a portion immediately before the turbine crawler or a group of turbine crawlers in the upstream-side region of the turbine crawler or the group of turbine crawlers is P2; a pressure value at a portion immediately after the turbine crawler or the group of turbine crawlers in the downstream-side region of the turbine crawler or the group of turbine crawlers is P3; a pressure value at the end of the downstream side of the pipe is P4; P1-P4=PL1; P2-P3=PL2; and, PL1-PL2=PL3;

the value A is set such that: PL1 that is an overall pressure loss value becomes smaller than P0 that is the maximum delivery pressure value of the fluid supply device but close to P0; and PL2 that is a pressure loss value in the turbine crawler or the group of turbine crawlers becomes smaller than PL1 but close to PL1, i.e., such that when the value A becomes smaller the value of PL2 becomes larger.

2. An intra-pipe turbine blast system for performing work by moving along the inside of a pipe and spraying, toward the inside, a three-phase fluid of a gas, a liquid and solid particles, comprising:

at least a turbine crawler or a plurality of turbine crawlers for moving along the inside of the pipe and spraying a fluid toward the inside of the pipe, turbine crawler connecting member(s) that are arranged inside the pipe in a series from an upstream side to a downstream side and connect the plurality of turbine crawlers when the plurality of turbine crawlers are disposed, a fluid supply device that is disposed outside the pipe for supplying a fluid from an upstream end of the pipe to the inside of the pipe, and a moving device such as a winch that moves the turbine crawler(s) along the inside of the pipe;

wherein, the turbine crawler comprises at least a mainframe member, an intra-pipe surface-contact sealing member and a rotor;

the mainframe member has an annular shape, the intra-pipe surface-contact sealing member is mounted on an outer peripheral end of the mainframe member, a fluid supply hole is formed at a central part of the mainframe member, and a bearing member is further mounted at the central part of the mainframe member for holding a rotor rotating shaft, which is a member constituting the rotor;

the intra-pipe surface-contact sealing member has an annular shape as a whole and is formed such that it can come into a close contact with the inner surface of the pipe;

the rotor comprises the rotor rotating shaft held on the bearing member on one side thereof, a first boss member mounted on the other side of the rotor rotating shaft, a second boss member disposed at an outer peripheral part of the first boss member, and a single or a plurality of rotating nozzle(s) mounted at an outer peripheral part of the second boss member;

when a plurality of turbine crawlers are disposed inside the pipe, rotating joint(s) are disposed as turbine crawler connecting members for connecting a plurality of rotor rotating shafts arranged in a series;

an annular-shaped rotor central space is further formed in the rotor between the outer peripheral surface of the first boss member and the inner peripheral surface of the second boss member, and in the rotor central space, a fluid supplied hole which is one side of the rotor central space faces the fluid supply hole of the mainframe as airtightly as possible, i.e., the fluid supply hole and the fluid supplied hole are linked with each other as airtightly as possible and in a mutually rotatable manner;

in the rotor, furthermore, an other side of the rotor central space is blocked airtightly;

in the rotor, furthermore, an upstream-side end of the rotating nozzle is linked to the rotor central space, and a downstream-side end of the rotating nozzle is open to an inner space of the pipe;

as such, in the rotor, a rotor passage is formed from the fluid supply hole of the mainframe as an upstream-side starting point to a rotating nozzle outlet as a downstream-side endpoint via the fluid supplied hole, the rotor central space and the rotating nozzle, and in the rotor passage, wherein an amount per unit time of a fluid flowing into the rotor central space from the fluid supplied hole is a value Q and that the minimum cross-sectional area of the passage through which a fluid having the flowing amount value Q passes is a value A; and in the intra-pipe turbine blast system having the configuration described above, wherein at and after a start of the operation of the fluid supply device, in which an absolute value of the maximum delivery pressure is P0 at said start, a relationship between the value A and absolute pressure values at several positions inside the pipe is set as follows;

under the following conditions: a pressure value at the end of the upstream side of the pipe is P1; a pressure value at a portion immediately before the turbine crawler or a group of turbine crawlers in the upstream-side region of the turbine crawler or the group of turbine crawlers is P2; a pressure value at a portion immediately after the turbine crawler or the group of turbine crawlers in the downstream-side region of the turbine crawler or the group of turbine crawlers is P3; and a pressure value at the end of the downstream side of the pipe is P4; P1-P4=PL1; P2-P3=PL2; and, PL1-PL2=PL3; the value A is set such that: PL1 that is an overall pressure loss value becomes smaller than P0 that is the maximum delivery pressure value of the fluid supply device but close to P0; and PL2 that is a pressure loss value in the turbine crawler or the group of turbine crawlers becomes smaller than PL1 but close to PL1, i.e., such that when the value A becomes smaller the value of PL2 becomes larger;

wherein, the intra-pipe turbine blast system is further characterized in that:

the fluid supply device comprises at least a gas pump such as a blower and a roots pump for injecting a gas into the pipe, a liquid pump for injecting a liquid into the pipe, and a solid particle supply device for injecting solid particles into the pipe;

the gas injected from the gas pump imparts speed to a mixed-phase fluid of the liquid and the solid particles flowing inside the pipe;

a flow speed of the mixed-phase fluid of the liquid and the solid particles flowing inside the pipe is set to a flow speed equal to or greater than a critical flow speed at which the solid particles can float without precipitating in the liquid, wherein the flow speed of the mixed-phase fluid is imparted and set by an action of the gas flowing inside the pipe, which is caused by the amount and pressure of the flowing gas.

3. An intra-pipe turbine blast system for performing work by moving along the inside of a pipe and spraying, toward the inside, a single-phase fluid of a gas or a liquid, a two-phase fluid of a gas and a liquid, a two-phase fluid of a gas or a liquid and solid particles such as a polishing material, or a three-phase fluid of a gas, a liquid and solid particles, comprising:

at least a turbine crawler or a plurality of turbine crawlers for moving along the inside of the pipe and spraying a fluid toward the inside of the pipe, turbine crawler connecting member(s) that are arranged inside the pipe in a series from an upstream side to a downstream side and connect the plurality of turbine crawlers when the plurality of turbine crawlers are disposed, a fluid supply device that is disposed outside the pipe for supplying a fluid from an upstream end of the pipe to the inside of the pipe, a fluid suction device that is disposed outside the pipe for suctioning the fluid inside the pipe from a downstream end of the pipe, and a moving device such as a winch that moves the turbine crawler(s) along the inside of the pipe;

wherein, the turbine crawler comprises at least a mainframe member, an intra-pipe surface-contact sealing member and a rotor;

the mainframe member has an annular shape, the intra-pipe surface-contact sealing member is mounted on an outer peripheral end of the mainframe member, a fluid supply hole is formed at a central part of the mainframe member, and a bearing member is further mounted at the central part of the mainframe member for holding a rotor rotating shaft, which is a member constituting the rotor;

the intra-pipe surface-contact sealing member has an annular shape as a whole and is formed such that it can come into a close contact with the inner surface of the pipe;

the rotor comprises the rotor rotating shaft held on the bearing member on one side thereof, a first boss member mounted on the other side of the rotor rotating shaft, a second boss member disposed at an outer peripheral part of the first boss member, and a single or a plurality of rotating nozzle(s) mounted at an outer peripheral part of the second boss member;

when a plurality of turbine crawlers are disposed inside the pipe, rotating joint(s) are disposed as turbine crawler connecting members for connecting a plurality of rotor rotating shafts arranged in a series;

an annular-shaped rotor central space is further formed in the rotor between the outer peripheral surface of the first boss member and the inner peripheral surface of the second boss member, and in the rotor central space, a fluid supplied hole which is one side of the rotor central space faces the fluid supply hole of the mainframe as airtightly as possible, i.e., the fluid supply hole and the fluid supplied hole are linked with each other as airtightly as possible and in a mutually rotatable manner;

in the rotor, furthermore, an other side of the rotor central space is blocked airtightly;

in the rotor, furthermore, an upstream-side end of the rotating nozzle is linked to the rotor central space, and a downstream-side end of the rotating nozzle is open to the inner space of the pipe;

as such, in the rotor, a rotor passage is formed from the fluid supply hole of the mainframe as an upstream-side starting point to a rotating nozzle outlet as a downstream-side endpoint via the fluid supplied hole, the rotor central space and the rotating nozzle, and in the rotor passage, wherein the amount per unit time of a fluid flowing into the rotor central space from the fluid supplied hole is a value Q and that the minimum cross-sectional area of the passage through which a fluid having the flowing amount value Q passes is a value A; and in the intra-pipe turbine blast system having the configuration described above, wherein at and after a start of the operation of the fluid suction device, in which an absolute value of the maximum suction pressure is P5 at said start, a relationship between the value A and absolute pressure values at several positions inside the pipe is set as follows;

under the following conditions: a pressure value at the end of the upstream side of the pipe is P1; a pressure value at a portion immediately before the turbine crawler or a group of turbine crawlers in the upstream-side region of the turbine crawler or the group of turbine crawlers is P2; a pressure value at a portion immediately after the turbine crawler or the group of turbine crawlers in the downstream-side region of the turbine crawler or the group of turbine crawlers is P3; a pressure value at the end of the downstream side of the pipe is P4; P1-P4=PL1; P2-P3=PL2; and, PL1-PL2=PL3; the value A is set such that: PL1 that is an overall pressure loss value becomes smaller than P5 that is the maximum suction pressure value of the fluid suction device but close to P5; and PL2 that is a pressure loss value in the turbine crawler or the group of turbine crawlers becomes smaller than PL1 but close to PL1, i.e., such that when the value A becomes smaller the value of PL2 becomes larger.

4. An intra-pipe turbine blast system for performing work by moving along the inside of a pipe and spraying, toward the inside, a three-phase fluid of a gas, a liquid and solid particles, comprising:

at least a turbine crawler or a plurality of turbine crawlers for moving along the inside of the pipe and spraying a fluid toward the inside of the pipe, turbine crawler connecting member(s) that are arranged inside the pipe in a series from an upstream side to a downstream side and connect the plurality of turbine crawlers when the plurality of turbine crawlers are disposed, a fluid supply device that is disposed outside the pipe for supplying a fluid from an upstream end of the pipe to the inside of the pipe, a fluid suction device that is disposed outside the pipe for suctioning the fluid inside the pipe from a downstream end of the pipe, and a moving device such as a winch that moves the turbine crawler(s) along the inside of the pipe;

wherein, the turbine crawler comprises at least a mainframe member, an intra-pipe surface-contact sealing member and a rotor;

the mainframe member has an annular shape, the intra-pipe surface-contact sealing member is mounted on an outer peripheral end of the mainframe member, a fluid supply hole is formed at a central part of the mainframe member, and a bearing member is further mounted at the central part of the mainframe member for holding a rotor rotating shaft, which is a member constituting the rotor;

the intra-pipe surface-contact sealing member has an annular shape as a whole and is formed such that it can come into close contact with the inner surface of the pipe;

the rotor comprises the rotor rotating shaft held on the bearing member on one side thereof, a first boss member mounted on the other side of the rotor rotating shaft, a second boss member disposed at an outer peripheral part of the first boss member, and a single or a plurality of rotating nozzle(s) mounted at an outer peripheral part of the second boss member;

when a plurality of turbine crawlers are disposed inside the pipe, rotating joint(s) are disposed as turbine crawler connecting members for connecting a plurality of rotor rotating shafts arranged in a series;

an annular-shaped rotor central space is further formed in the rotor between the outer peripheral surface of the first boss member and the inner peripheral surface of the second boss member, and in the rotor central space, a fluid supplied hole which is one side of the rotor central space faces the fluid supply hole of the mainframe as airtightly as possible, i.e., the fluid supply hole and the fluid supplied hole are linked with each other as airtightly as possible and in a mutually rotatable manner;

in the rotor, furthermore, an other side of the rotor central space is blocked airtightly;

in the rotor, furthermore, an upstream-side end of the rotating nozzle is linked to the rotor central space, and a downstream-side end of the rotating nozzle is open to the inner space of the pipe;

as such, in the rotor, a rotor passage is formed from the fluid supply hole of the mainframe as an upstream-side starting point to a rotating nozzle outlet as a downstream-side endpoint via the fluid supplied hole, the rotor central space and the rotating nozzle, and in the rotor passage, wherein an amount per unit time of a fluid flowing into the rotor central space from the fluid supplied hole is a value Q and that the minimum cross-sectional area of the passage through which a fluid having the flowing amount value Q passes is a value A; and in the intra-pipe turbine blast system having the configuration described above, wherein at and after a start of the operation of the fluid suction device, in which an absolute value of the maximum suction pressure is P5 at said start, a relationship between the value A and absolute pressure values at several positions inside the pipe is set as follows;

under the following conditions: a pressure value at the end of the upstream side of the pipe is P1; a pressure value at a portion immediately before the turbine crawler or a group of turbine crawlers in the upstream-side region of the turbine crawler or the group of turbine crawlers is P2; a pressure value at a portion immediately after the turbine crawler or the group of turbine crawlers in the downstream-side region of the turbine crawler or the group of turbine crawlers is P3; a pressure value at the end of the downstream side of the pipe is P4, P1-P4=PL1; P2-P3=PL2; and PL1-PL2=PL3; the value A is set such that: PL1 that is an overall pressure loss value becomes smaller than P5 that is the maximum suction pressure value of the fluid suction device but close to P5; and PL2 that is a pressure loss value in the turbine crawler or the group of turbine crawlers becomes smaller than PL1 but close to PL1, i.e., such that when the value A becomes smaller the value of PL2 becomes larger;

wherein the intra-pipe turbine blast system is further characterized in that:

the fluid supply device comprises at least a pipeline for injecting a gas into the pipe, a liquid pump for injecting a liquid into the pipe, and a solid particle supply device for injecting solid particles into the pipe;

the fluid suction device comprises at least a gas pump such as a roots pump for suctioning a gas from the inside of the pipe;

the gas injected from the pipeline for injecting the gas imparts speed to a mixed-phase fluid of the liquid and the solid particles flowing inside the pipe;

a flow speed of the mixed-phase fluid of the liquid and the solid particles flowing inside the pipe is set to a flow speed equal to or greater than the critical flow speed at which the solid particles can float without precipitating in the liquid, wherein the flow speed of the mixed-phase fluid is imparted and set by an action of the gas flowing inside the pipe, which is caused by the amount and pressure of the flowing gas.

5. The intra-pipe turbine blast system according to claim 1, wherein in the rotor, the shaft line of a jet sprayed from the rotating nozzle outlet is disposed at a position where the jet imparts rotating torque to the rotor.

6. The intra-pipe turbine blast system according to claim 2, wherein in the rotor, the shaft line of a jet sprayed from the rotating nozzle outlet is disposed at a position where the jet imparts rotating torque to the rotor.

7. The intra-pipe turbine blast system according to claim 3, wherein in the rotor, the shaft line of a jet sprayed from the rotating nozzle outlet is disposed at a position where the jet imparts rotating torque to the rotor.

8. The intra-pipe turbine blast system according to claim 4, wherein in the rotor, the shaft line of a jet sprayed from the rotating nozzle outlet is disposed at a position where the jet imparts rotating torque to the rotor.

* * * * *